US006339686B2

(12) United States Patent
Yamanaka et al.

(10) Patent No.: US 6,339,686 B2
(45) Date of Patent: Jan. 15, 2002

(54) DEVELOPER UNIT WITH CLEANING ELEMENT

(75) Inventors: Takayuki Yamanaka, Tenri; Atsushi Inoue, Ikoma-gun; Eiichi Kido, Yamatokoriyama; Mikie Kobayashi, Uda-gun; Shigeyuki Wakada, Nara; Jitsuo Masuda, Yamatotakada; Toshihide Ohgoshi, Nara; Hiroshi Tatsumi, Shiki-gun; Masahiro Sakai, Osaka, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/749,037

(22) Filed: Dec. 28, 2000

(30) Foreign Application Priority Data

Dec. 28, 1999 (JP) ..... 11-374723
Jun. 15, 2000 (JP) ..... 12-180484

(51) Int. Cl.[7] ..... G03G 15/00
(52) U.S. Cl. ..... 399/43; 399/274; 399/284
(58) Field of Search ..... 118/261; 399/43, 399/119, 123, 274, 284

(56) References Cited

U.S. PATENT DOCUMENTS 4,930,438 A * 6/1990 Demizu et al. ..... 118/651
5,424,817 A * 6/1995 Imamiya et al. ..... 118/651
6,064,463 A 5/2000 Yamada et al.

FOREIGN PATENT DOCUMENTS

JP 5127509 5/1993
JP 7163440 6/1995
JP 7168440 7/1995

* cited by examiner

*Primary Examiner*—Sophia S Chen
*Assistant Examiner*—Hoang Ngo

(57) ABSTRACT

A cleaning element is arranged on the backside of the toner layer metering blade, i.e., the side opposite to the surface in contact with the developer support, in order to prevent the cleaning element from damaging the blade surface and the abutment surface of the metering blade against the developer support. This cleaning element is frictionally moved across the backside of the toner layer metering blade to remove stuck toner from the toner layer metering blade or prevent occurrence of buildups.

42 Claims, 16 Drawing Sheets

DEVELOPER UNIT WITH CLEANING ELEMENT

BACKGROUND OF THE INVENTION (1) Field of the Invention

The present invention relates to a developer unit for use in an image forming apparatus such as a copier, printer, facsimile machine, etc., for performing image forming based on the electrophotographic process, in particular is directed to removal of the toner stuck on the toner layer metering blade in a developer unit using a mono-component developer.

(2) Description of the Prior Art

The developer unit for a mono-component developer that contains no carrier, not only has a simple configuration and hence can be made compact because of absence of carrier particles but also offers the advantages of low cost and easy maintenance. In particular, since a non-magnetic mono-component toner that does not contain magnetic toner, does not use a magnetic roller, it is possible to provide an inexpensive, compact, developer unit creating clear images. Further, since the toner does not contain any magnetic material, toner of this type is suitable to be utilized for color imaging. When classifying mono-component developer units based on their developing methods, there have been two known methods, one for the contact developing system for performing development by being in contact with the photoreceptor, and the other for the non-contact developing system for performing development by being not in contact with the photoreceptor.

Generally, in a mono-component developing method in which either the toner is magnetic or non-magnetic, and either the system is in the contact type or non-contact type, a thin layer of the electrified mono-component toner is formed on a developer support, and this thin layer is conveyed with the rotation of the developer support to the developing position where the toner opposes the photoreceptor with a latent image formed thereon, whereby the latent image on the photoreceptor is made into a visible (developed) image. In this case, in order to obtain high quality images, the way that a stable thin toner layer, uniformly charged, and with a uniform thickness is formed on the developer support is very important.

Typically, electrification and formation of the thin toner layer on the developer support are performed using a toner layer metering blade which is pressed against the developer support with a predetermined pressure. Charging and formation of the thin toner layer may be beneficial in the initial stage of use, but toner may stick to the toner layer metering blade after a long period of use, failing to form a preferable toner layer, causing image degradation. Actually, continuous abutment of the toner layer metering blade against the developer support at the predetermined pressure will cause the toner to adhere (stick) to the blade surface within the abutment nip between the toner layer metering blade and the developer support and therearound, due to frictional heat, the pressure and/or environmental factors such as the temperature in the machine and the like.

Such buildups are slight and formed as a thin film at their initial stage, posing no problem in image forming, but will grow as the machine is used, soon presenting adverse effects in the image.

Actually, the stuck buildups deteriorate toner electrification performance by the toner layer metering blade, and clog the toner inflow opening between the blade and the developer support, forming physical irregularities on the surface in contact with the developer support, which causes widespread or local reduction in thickness of the toner layer or excessive toner passing (increase in toner layer thickness), making it impossible to form a uniform and even toner layer. As this result, light print, local white lines, and local black streaks (when monochrome) and the like arise on the image.

In order to solve this problem, some methods of cleaning the stuck toner on the toner layer metering blade have been proposed. For example, Japanese Patent Application Laid-Open Hei 7 No.163440 discloses a stuck toner removal member which is slidable between the developer support and the toner layer metering blade and removes stuck toner as it slides. This publication further discloses another configuration wherein the toner layer metering blade is configured so as to slide up and down along the developer support and sliding the toner layer metering blade up and down removes the stuck buildups.

Japanese Patent Application Laid-Open Hei 5 No.127509 discloses another configuration wherein with the toner layer metering blade fixed to a movement driver, the movement driver is actuated so as to vary the abutment position between the toner layer metering blade and the developer roller, thus preventing toner from sticking to the toner layer metering blade.

As in Japanese Patent Application Laid-Open Hei 7 No.163440, inserting and sliding a removal member between the developer support and the toner layer metering blade abrades the toner layer metering blade surface as well as the developer support and may damage the both.

In general, the toner layer metering blade is pressed against the developer support with a linear pressure of some tens of gf/cm to some hundreds of gf/cm, depending on the configuration. It is not so easy to slide the inserted removal member between the toner layer metering blade and the developer support without damaging them. In the configuration of the above disclosure, the edges of the removal member are finished with precision, needing a high cost. Further, in order to avoid damage, it is necessary to slide the removal member without its being scratched as it moves and move it straightly keeping its face angle constant.

That is, the method described in the above publication, makes it possible to remove stuck buildups from the toner layer metering blade, but are liable to damage the developer support surface as well as the toner layer metering blade and also causes a cost increase. By any means, moving the removal member whilst keeping it in contact with both elements may cause a certain amount of damage.

Further, in the case of Japanese Patent Application Laid-Open Hei 5 No.127509, a movement driver means to which fixing the toner layer metering blade is fixed is additionally needed, leading to a sharp cost increase because of the necessity of the controller means for this movement driver means and needing extra space for setting it. Therefore, application of this method to existing apparatus is limited. In accordance with the method disclosed in the configuration of the above publication, since the toner layer metering blade is moved rubbing the developer roller when the abutment position between the toner layer metering blade and the developer roller shifts, it is not preferred because there is a risk of damaging both the developer roller and the toner layer metering blade.

SUMMARY OF THE INVENTION

In order to solve the above problems, the present inventors hereof have studied intensively and found that instead of using the technique of inserting a cleaning element between the developer support and the toner layer metering blade, adoption of a configuration in which a cleaning element is arranged on the backside of the toner layer metering blade, i.e., the side opposite to the surface in contact with the developer support so that the cleaning element can frictionally move relative to the toner layer metering blade will lower the risk that the cleaning element might cause damage, as it rubs, to the toner layer metering blade surface and the developer support surface on which the metering blade abuts, and will remove the stuck toner on the toner layer metering blade as well as preventing the occurrence of stuck buildups.

At the toner layer metering blade, if the toner stops moving at the same place, the same mass of toner continues to be stressed, soon becomes transmuted, forming stuck buildup. Even in such cases, the stationary toner residing around the blade edge can be removed and eliminated by rubbing of the cleaning element around the blade edge from the backside of the blade, instead of rubbing the blade from the developer support side.

Thus, it is possible to eliminate the situation where the same mass of toner is being stressed by remaining at the. same place, resultantly it is possible to delay the emergence of stuck buildups and the growing of them. Further, even if the stuck buildups have already grown, being projected from the blade edge, parts of the buildups which can be seen from the backside edge of the blade, may be removed from the blade backside. Because the stuck buildups are unified with the buildups on the blade abutment side (opposing the developer support), the stuck buildup can be removed altogether including that part on abutment surface side.

That is, when a stuck buildup has already formed, instead of rubbing the buildup at the abutment nip around which the buildup sticks most firmly, areas to which the buildup sticks less firmly may and should be rubbed because the stuck buildup is one-piece. Accordingly, areas in some part away from the nip or the portion projected from the blade distal part (edge) are rubbed by a force acting in the direction different from that of the blade's pressing force, so that the stuck buildup can be removed with a small force. As a result, it is possible to eliminate and prevent white lines, black streaks, light images which attributes to stuck buildups on the blade.

As stated above, this blade backside scraping method using a cleaning element, compared to the method of interposing a cleaning element between the developer support and the blade, is not only effective in preventing damage to the abutment surface of the blade and developer support, but also does not need to produce a force opposing the urging force of the blade on the developer support, hence allows the cleaning element to scrape with a low energy.

The direction of sliding movement of the cleaning element can be selected from two types, one for widthwise movement in which the cleaning element is moved from the fixed end (supported end) side of the blade to the free end (abutment edge) side and the other type for lengthwise movement in which the cleaning element is slid in the lengthwise direction of the blade. The configurations of cleaning elements will be explained separately for the blade widthwise movement type and for the blade lengthwise movement type.

First, in the case of blade widthwise movement type, the cleaning element is slid from the fixed end (supported end) side of the blade to the free end (abutment edge) side, so as to thrust (or draw) out stuck buildups or adhering substances in the direction of open space, thus making it possible to effectively remove the stuck buildups and adhering substances. Further, when the direction of abutment of the blade is in the leading direction, the cleaning element is able to act on the buildups or stationary toner with a force in the direction opposite to that acting on the buildups by the toner flowing in from the upstream side while the developer support normally rotates, thus making it possible to remove them effectively.

The dimension of the cleaning element in the lengthwise direction of the blade is not particularly limited. For example, the cleaning element may have a strip-like configuration, i.e., with a long side in the vertical direction, or may have a horizontal side approximately equal to the blade length. For a strip-like configuration, the cleaning element needs to be moved along the length of the blade. When the cleaning element is adapted to have a horizontal side approximately equal to the blade length, the full length of the blade can be cleaned all at once, thus making it possible to effectively clean the blade by a single (or some times of) vertical movement (blade widthwise movement) which is preferable.

The shape of the cleaning element is not particularly limited, but adoption of a sheet-like configuration, particularly, thin plate-like sheet configuration, makes the cleaning element simple, and makes it possible to efficiently scrape the stuck buildups by the edges of the sheet-like element.

Both horizontal side ends of the cleaning element may be formed linearly or curved. When the ridgelines or edges (or sides if they are linear) are not in parallel with the direction of movement of the cleaning element (the direction of movement from the fixed end side of the blade to the free end side), but are inclined, it is possible to prevent the edges, i.e., ridgelines of the cleaning element from rubbing the same point on the surface of the developer support and the backside of the blade while the cleaning element moves. Therefore, it is possible to prevent this scraping movement from damaging the developer roller surface and the blade edge part.

If the width, or dimension of projection from the proximal end, of the cleaning element, perpendicular to the lengthwise direction thereof is varied, the side edges of the sheet-like cleaning element can be inclined relative to the direction of sliding movement (the direction of movement from the fixed end side to the distal end side of the blade). Therefore, the edge of the cleaning element abuts a stuck buildup at only a point (only some points), so that the applied force on the cleaning element can be concentrated on that point while a force having a different force component from the direction of movement of the cleaning element can be applied to the buildup. This makes it possible to remove stuck buildups more efficiently. In practice, stuck buildups are clustered or entangled to each other, so instead of applying a removal force on the cluster, all at once, application of the removal force locally and concentratively on part of the buildup, makes it possible to effectively remove the buildup at that part.

Since the abutment point (cleaning point) of the edge of the cleaning element against the distal part of the blade continuously moves as the cleaning element moves down, the buildups can be removed successively. During this process, since the point of cleaning moves from the side where removal has been done to the unremoved side, it is possible to make the force act from the side where removal has been done, and hence stuck buildups can be efficiently peeled off.

In this case, if the cleaning element is formed with its width or the dimension of projection from its proximal end on the left being a mirror image of that on the right, ('on the left' and 'on the right' are referred to with respect to the lengthwise direction of the cleaning element), the forces acting on the cleaning element during its sliding for cleaning, also become axially symmetrical, therefore the warp and distortion of the cleaning element can be prevented or reduced. As a result, a thin and soft sheet-like material can be used for the cleaning element, which is able to further lower the risk of the cleaning element damaging the developer support and the blade.

When the length, or the horizontal dimension of the cleaning element is approximately equal to that of the blade, the cleaning effect on the blade becomes symmetrical with respect to the midpoint of the axis of the developer support. Therefore, if an image defect occurs due to cleaning defects attributing to the shape or distortion of the cleaning element, the image defect will be also symmetrical and hence inconspicuous.

When the width or dimension of projection from its proximal end of the cleaning element varies linearly, stuck buildups can be removed locally and successively, and because of the linear variation in width, the same force (the horizontal and vertical force components) not varying in its direction can be applied at any position, thus making it possible to remove stuck buildups uniformly.

The configuration of the cleaning element is not particularly limited as long as it can frictionally slide along the toner layer metering blade and remove stuck buildups. However, when a soft and flexible member or brush-like member attached to an elastic thin plate-like support is adopted, a strong enough force in the urging direction can be applied through the contact area still there is no risk of damaging the developer support.

Next, the configuration of the cleaning element of the blade lengthwise movement type will be explained. In the case of the blade lengthwise movement type, since the cleaning element will not be moved in the widthwise direction, the dimension in the widthwise direction of the cleaning element has to be at least large enough to be in contact with the distal end of the blade while there is no need to have a length equal to the blade length and a strip-like configuration can be used.

The thickness of this cleaning element is not particularly limited. Similarly to the widthwise movement type, a sheet-like member, a soft and flexible member or brush-like member attached to an elastic thin-plate like support can be adopted.

In the case of the blade lengthwise movement type, both side edges of the cleaning element with respect to the lengthwise direction function as the scrapers acting on the blade. Even if the sectional shape of the cleaning element is cut straight a certain degree of buildup removal effect can be obtained, but if the cleaning element is provided at both sides with sloping portions toward the directions of movement, the buildup removal effect can be more enhanced. As examples of the slopes, a sheet-like cleaning element may be formed with obtusely angled tabs at both sides thereof, or may be formed with curved tabs at both sides thereof. Further, both sides may be bent at right angles.

Concerning the shape of the distal edge of the sloping tab, other than that particularly unshaped, the edge portion may be cut along the contact angle with the toner layer metering blade forming a knife-edge configuration. Alternatively, the edge may be formed with a knife-edge configuration which will come in point contact with the blade or share a smaller contact area with the blade. Further, it is possible to employ a wedge-shaped edge configuration which is thick at the proximal side and is tapered to a distal edge toward the direction of movement. In either case, the buildup removal effect can be enhanced.

It is also possible to enhance the buildup removal effect by providing jagged edges on both sides of the cleaning element. Examples of formation of jagged edges include a saw-toothed configuration, wavy configuration and rectangular wavy configuration.

As another configuration, a plurality of slots in parallel with the edges on both sides may be formed in the cleaning element. In this case, provision of the slots enables the toner and other particles existing between the toner layer metering blade and the cleaning element to be discharged while the cleaning element is being slid, whereby it is possible to remove an elastic thin plate-like support buildups in a more effective manner.

The movement of the cleaning element in the lengthwise or widthwise direction can be carried out manually or by various drive mechanisms. In the case of using a drive mechanism, the cleaning operation can be effected at various timings in association with the conditions or operations of the image forming apparatus. For example, in an image forming apparatus having a counter means capable of counting, at least one of the number of image formed printouts, the operating time and the number of rotations of the developer support, it is preferred that the apparatus is controlled so that the cleaning operation is performed when the counted value on the counter means reaches the predetermined value.

In this way, periodic execution of cleaning the toner layer metering blade makes it possible to remove stuck buildups and prevent their growth, or emergence of a buildup itself over a long period. As a result, excellent images free from white lines, high-density streaks (black lines), light images, which all accompany stuck toner on the toner layer metering blade, can be obtained over a long term.

Further, in a developer unit which is applied to an image forming apparatus including a controller for controlling the image forming process conditions and the like by effecting image adjustment so as to provide optimal printed-out images when power is activated, when the number of printouts reaches the predetermined value, when the predetermined time elapses and/or when the machine has recovered from the energy saving mode, the controller controls the cleaning element so as to perform the cleaning operation before or in parallel with the image adjustment. This configuration enables the image adjustment to be performed with the image degradation which would occur due to stuck toner on the toner layer metering blade, whereby it is possible to obtain excellent images. Further, since the toner layer metering blade can be cleaned periodically in time with the image adjustment, it is possible to maintain beneficial images over a long period.

By providing a system in which the cleaning element is operated to clean the distal part of the toner layer metering blade every time the toner container cartridge is replaced to supply fresh toner to the developer hopper, the cleaning can be done approximately periodically. Further, since when fresh toner is re-supplied, little stresses arise while cleaning the blade, cleaning at this timing is also effective in reviving the electrifying function of the blade. At the timing of toner replenishing, the toner in the developer hopper is almost used up. That is, the amount of toner in the developer hopper is relatively low (the hopper is not full of toner), so that the cleaning element can perform its cleaning operation without any obstacles and hence can efficiently remove stuck substances around the distal part of the blade.

By providing a system in which this cleaning element is integrated with the toner replenishing cartridge for replenishing fresh toner so as to enable cleaning when the toner replenishing cartridge is attached, it is possible to perform cleaning approximately periodically at the timing of replacement of the toner cartridge. Since the cleaning element is provided for the toner replenishing cartridge, there is no need to provide a cleaning element on the developer hopper side, and hence there is no need to provide a special configuration on the developer hopper side.

As an arrangement of the cleaning element in the developer unit, the cleaning element may be attached to the agitator in the unit so that the cleaning element will clean the distal part of the toner layer metering blade with the agitating operation of the agitator. In this configuration, the cleaning element can be made to function as a mixing element, so that the blade (backside) can be continuously cleaned in time with mixing. Further, since the toner cluster or stuck buildups removed by cleaning can be agitated and dispersed as is in the developer hopper, it is possible to lower the risk of the buildups flowing into the blade abutment portion.

The above toner layer metering blade and cleaning element can be applied to various developer units having different types of toner. In particular, this configuration is favorably applied to a developer unit of a non-magnetic mono-component toner development type.

Thus, the present invention is configured as above and the main features are described as follows:

In accordance with the first aspect of the present invention, a developer unit includes: a toner layer metering blade disposed in pressure contact with the developer support surface for adjusting the thickness of the toner layer on the developer support surface; and a cleaning element for removing stuck toner around the abutment edge of the toner layer metering blade against the developer support, and is characterized in that the cleaning element is arranged on the backside of the toner layer metering blade, the side opposite to the surface in contact with the developer support and can be frictionally slid from the fixed edge to the distal edge of the toner layer metering blade.

In accordance with the second aspect of the present invention, the developer unit having the above first feature is characterized in that the length or horizontal dimension of the cleaning element is set approximately equal to the length of horizontal dimension of the toner layer metering blade.

In accordance with the third aspect of the present invention, the developer unit having the above first feature is characterized in that the cleaning element is of a sheet-like configuration.

In accordance with the fourth aspect of the present invention, the developer unit having the above first feature is characterized in that the both the sides or ridgelines at both horizontal ends of the cleaning element are inclined with respect to the direction of movement of the cleaning element.

In accordance with the fifth aspect of the present invention, the developer unit having the above first feature is characterized in that the cleaning element is of a sheet-like configuration and the width, or dimension of projection from the proximal end, of the cleaning element varies along the long side of the toner layer metering blade.

In accordance with the sixth aspect of the present invention, the developer unit having the above fifth feature is characterized in that the cleaning element has an axial symmetrical shape about the medial line with respect to the length thereof with its width or the dimension of projection from its proximal end on the left is the mirror image of that on the right.

In accordance with the seventh aspect of the present invention, the developer unit having the above sixth feature is characterized in that the width or dimension of projection from its proximal end of the cleaning element varies linearly.

In accordance with the eighth aspect of the present invention, a developer unit includes: a toner layer metering blade disposed in pressure contact with the developer support surface for adjusting the thickness of the toner layer on the developer support surface; and a cleaning element for removing stuck toner around the abutment edge of the toner layer metering blade against the developer support, and is characterized in that the cleaning element is comprised of a soft and flexible member applied on an elastic thin plate-like support, is arranged on the backside of the toner layer metering blade, the side opposite to the surface in contact with the developer support and can be frictionally slid from the fixed edge to the distal edge of the toner layer metering blade.

In accordance with the ninth aspect of the present invention, a developer unit includes: a toner layer metering blade disposed in pressure contact with the developer support surface for adjusting the thickness of the toner layer on the developer support surface; and a cleaning element for removing stuck toner around the abutment edge of the toner layer metering blade against the developer support, and is characterized in that the cleaning element is comprised of a brush-like member applied to an elastic thin plate-like support, is arranged on the backside of the toner layer metering blade, the side opposite to the surface in contact with the developer support and can be frictionally slid from the fixed edge to the distal edge of the toner layer metering blade.

In accordance with the tenth aspect of the present invention, the developer unit having the above first feature is characterized in that the cleaning element is integrally attached to the toner container cartridge for supplying fresh toner.

In accordance with the eleventh aspect of the present invention, the developer unit having the above first feature is characterized in that the cleaning element is attached to an agitating element inside the developer unit so as to clean the distal part of the toner layer metering blade in time with the agitating action of the agitating element.

In accordance with the twelfth aspect of the present invention, a developer unit includes: a toner layer metering blade disposed in pressure contact with the developer support surface for adjusting the thickness of the toner layer on the developer support surface; and a cleaning element for removing stuck toner around the abutment edge of the toner layer metering blade against the developer support, and is characterized in that the cleaning element is arranged on the backside of the toner layer metering blade, the side opposite to the surface in contact with the developer support and can be frictionally slid along the long side of the toner layer metering blade.

In accordance with the thirteenth aspect of the present invention, the developer unit having the above twelfth feature is characterized in that the cleaning element can be reciprocated or vibrated along the long side of the toner layer metering blade.

In accordance with the fourteenth aspect of the present invention, the developer unit having the above twelfth feature, includes: a toner layer metering blade disposed in pressure contact with the developer support surface for adjusting the thickness of the toner layer on the developer support surface; and a cleaning element for removing stuck toner around the abutment edge of the toner layer metering blade against the developer support, and is characterized in that the cleaning element is of a sheet-like configuration, is arranged on the backside of the toner layer metering blade, the side opposite to the surface in contact with the developer support and can be frictionally slid along the long side of the toner layer metering blade.

In accordance with the fifteenth aspect of the present invention, the developer unit having the above fourteenth feature is characterized in that the sheet-like cleaning element has a pair of sloping tabs on both sides thereof with respect to the direction of movement, the edges of the sloping tabs are frictionally slidable along the toner layer metering blade.

In accordance with the sixteenth aspect of the present invention, the developer unit having the above fourteenth feature is characterized in that each of both side parts of the sheet-like cleaning element is thick at the proximal side and is tapered to a distal edge toward the direction of movement.

In accordance with the seventeenth aspect of the present invention, the developer unit having the above fourteenth feature is characterized in that both side parts of the sheet-like cleaning element with respect to the direction of movement are formed with jagged edges.

In accordance with the eighteenth aspect of the present invention, the developer unit having the above seventeenth feature is characterized in that both side parts of the sheet-like cleaning element with respect to the reciprocating direction are formed with wavy jagged edges.

In accordance with the nineteenth aspect of the present invention, the developer unit having the above seventeenth feature is characterized in that both side parts of the sheet-like cleaning element with respect to the reciprocating direction are formed with saw-toothed jagged edges.

In accordance with the twentieth aspect of the present invention, the developer unit having the above seventeenth feature is characterized in that both side parts of the sheet-like cleaning element with respect to the reciprocating direction are formed with rectangular wavy jagged edges.

In accordance with the twenty-first aspect of the present invention, the developer unit having the above fourteenth feature is characterized in that the sheet-like cleaning element has slots in parallel with the both side edges with respect to the reciprocating direction.

In accordance with the twenty-second aspect of the present invention, the developer unit having the above seventeenth feature is characterized in that the sheet-like cleaning element has slots in parallel with the both side edges with respect to the reciprocating direction, and the edge of the longest side of each slot is folded forming a folded portion.

In accordance with the twenty-third aspect of the present invention, the developer unit having the above twenty-second feature is characterized in that the edge of the longest side of each slot is folded and the folded portion is formed with a jagged edge.

In accordance with the twenty-fourth aspect of the present invention, a developer unit includes: a toner layer metering blade disposed in elastic contact with the developer support surface for adjusting the thickness of the toner layer on the developer support surface; and a cleaning element for removing stuck toner around the abutment edge of the toner layer metering blade against the developer support, and is characterized in that the cleaning element is comprised of a soft and flexible member applied to a thin plate-like support, is arranged on the backside of the toner layer metering blade, the side opposite to the surface in contact with the developer support and can be frictionally slid along the long side of the toner layer metering blade.

In accordance with the twenty-fifth aspect of the present invention, a developer unit includes: a toner layer metering blade disposed in elastic contact with the developer support surface for adjusting the thickness of the toner layer on the developer support surface; and a cleaning element for removing stuck toner around the abutment edge of the toner layer metering blade against the developer support, and is characterized in that the cleaning element is comprised of a brush-like member applied to a thin plate-like support, is arranged on the backside of the toner layer metering blade, the side opposite to the surface in contact with the developer support and can be frictionally slid along the long side of the toner layer metering blade.

In accordance with the twenty-sixth aspect of the present invention, the developer unit having the above first feature, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

In accordance with the twenty-seventh aspect of the present invention, the developer unit having the above first feature, which is applied to an image forming apparatus including a controller for controlling the image forming process conditions and the like by effecting image adjustment so as to provide optimal printed-out images when power is activated, when the number of printouts reaches the predetermined value, when the predetermined time elapses and/or when the machine has recovered from the energy saving mode, wherein the controller controls the cleaning element so as to perform the cleaning operation before or in parallel with the image adjustment.

In accordance with the twenty-eighth aspect of the present invention, the developer unit having the above first feature, further includes a controller for controlling the operation of the cleaning element, wherein the controller controls the cleaning element so that the cleaning element cleans the distal part of the toner layer metering blade when the toner container cartridge is replaced to replenish fresh toner to the developer hopper.

In accordance with the twenty-nineth aspect of the present invention, the developer unit having the above eighth feature, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

In accordance with the thirtieth aspect of the present invention, the developer unit having the above eighth feature, which is applied to an image forming apparatus including a controller for controlling the image forming process conditions and the like by effecting image adjustment so as to provide optimal printed-out images when power is activated, when the number of printouts reaches the predetermined value, when the predetermined time elapses and/or when the machine has recovered from the energy saving mode, wherein the controller controls the cleaning element so as to perform the cleaning operation before or in parallel with the image adjustment.

In accordance with the thirty-first aspect of the present invention, the developer unit having the above eighth feature, further includes a controller for controlling the operation of the cleaning element, wherein the controller controls the cleaning element so that the cleaning element cleans the distal part of the toner layer metering blade when the toner container cartridge is replaced to replenish fresh toner to the developer hopper.

In accordance with the thirty-second aspect of the present invention, the developer unit having the above ninth feature, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

In accordance with the thirty-third aspect of the present invention, the developer unit having the above ninth feature, which is applied to an image forming apparatus including a controller for controlling the image forming process conditions and the like by effecting image adjustment so as to provide optimal printed-out images when power is activated, when the number of printouts reaches the predetermined value, when the predetermined time elapses and/or when the machine has recovered from the energy saving mode, wherein the controller controls the cleaning element so as to perform the cleaning operation before or in parallel with the image adjustment.

In accordance with the thirty-fourth aspect of the present invention, the developer unit having the above ninth feature, further includes a controller for controlling the operation of the cleaning element, wherein the controller controls the cleaning element so that the cleaning element cleans the distal part of the toner layer metering blade when the toner container cartridge is replaced to replenish fresh toner to the developer hopper.

In accordance with the thirty-fifth aspect of the present invention, the developer unit having the above twelfth feature, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

In accordance with the thirty-sixth aspect of the present invention, the developer unit having the above twelfth feature, which is applied to an image forming apparatus including a controller for controlling the image forming process conditions and the like by effecting image adjustment so as to provide optimal printed-out images when power is activated, when the number of printouts reaches the predetermined value, when the predetermined time elapses and/or when the machine has recovered from the energy saving mode, wherein the controller controls the cleaning element so as to perform the cleaning operation before or in parallel with the image adjustment.

In accordance with the thirty-seventh aspect of the present invention, the developer unit having the above twelfth feature, further includes a controller for controlling the operation of the cleaning element, wherein the controller controls the cleaning element so that the cleaning element cleans the distal part of the toner layer metering blade when the toner container cartridge is replaced to replenish fresh toner to the developer hopper.

In accordance with the thirty-eighth aspect of the present invention, the developer unit having the above twenty-fourth feature, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

In accordance with the thirty-ninth aspect of the present invention, the developer unit having the above twenty-fourth feature, which is applied to an image forming apparatus including a controller for controlling the image forming process conditions and the like by effecting image adjustment so as to provide optimal printed-out images when power is activated, when the number of printouts reaches the predetermined value, when the predetermined time elapses and/or when the machine has recovered from the energy saving mode, wherein the controller controls the cleaning element so as to perform the cleaning operation before or in parallel with the image adjustment.

In accordance with the fortieth aspect of the present invention, the developer unit having the above twenty-fourth feature, further includes a controller for controlling the operation of the cleaning element, wherein the controller controls the cleaning element so that the cleaning element cleans the distal part of the toner layer metering blade when the toner container cartridge is replaced to replenish fresh toner to the developer hopper.

In accordance with the forty-first aspect of the present invention, the developer unit having the above twenty-fifth feature, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

In accordance with the forty-second aspect of the present invention, the developer unit having the above twenty-fifth feature, which is applied to an image forming apparatus including a controller for controlling the image forming process conditions and the like by effecting image adjustment so as to provide optimal printed-out images when power is activated, when the number of printouts reaches the predetermined value, when the predetermined time elapses and/or when the machine has recovered from the energy saving mode, wherein the controller controls the cleaning element so as to perform the cleaning operation before or in parallel with the image adjustment.

In accordance with the forty-third aspect of the present invention, the developer unit having the above twenty-fifth feature, further includes a controller for controlling the operation of the cleaning element, wherein the controller controls the cleaning element so that the cleaning element cleans the distal part of the toner layer metering blade when the toner container cartridge is replaced to replenish fresh toner to the developer hopper.

DESCRIPTION OF THE PREFERRED EMBODIMENTS

Schematic Configuration of a Developer Unit

Figure 1:
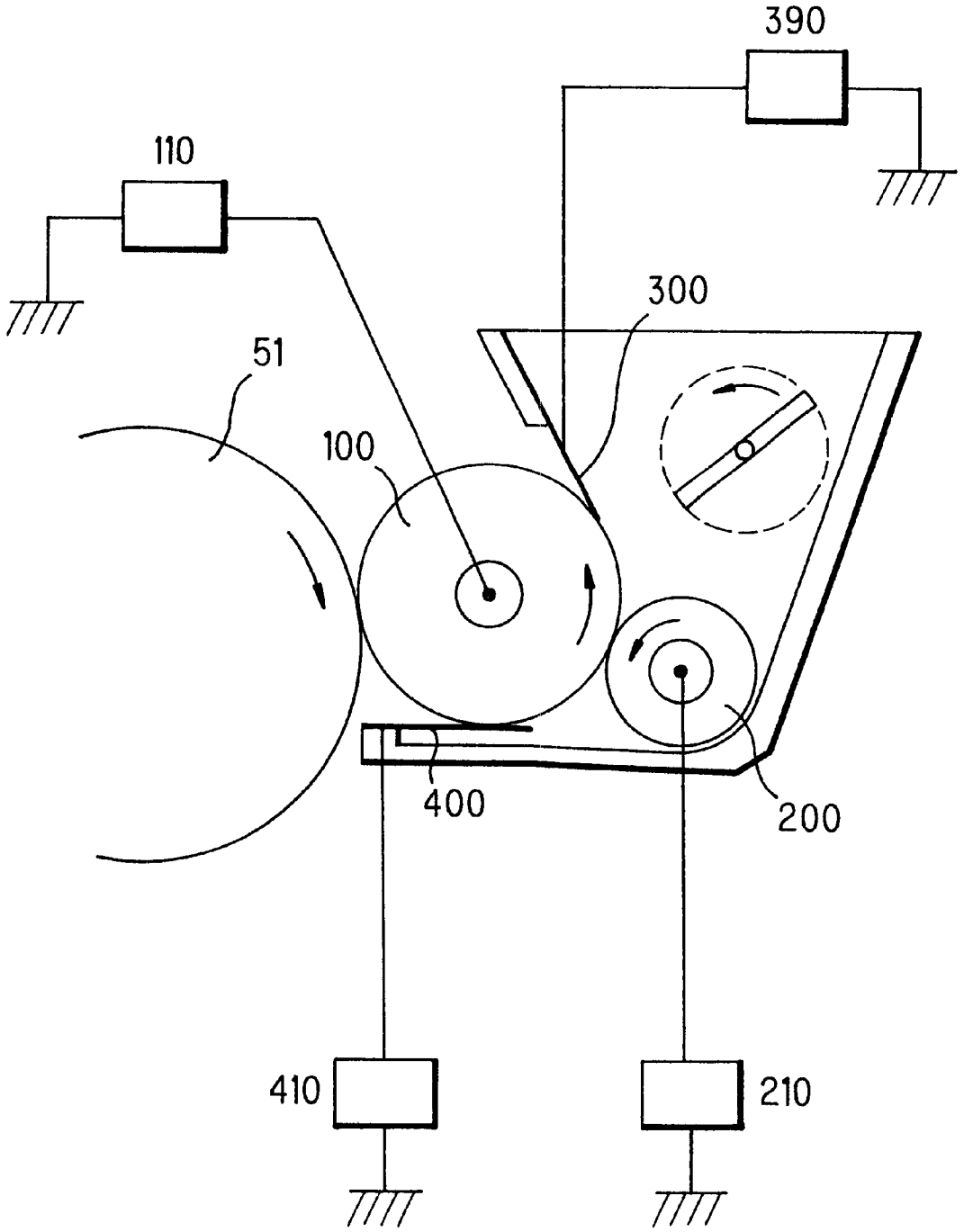
FIG. 1 is a schematic diagram showing a configuration of a developer unit in accordance with the present invention.

FIG. 1 is a schematic diagram showing a typical configurational example of a mono-component developer unit to which the present invention is applied. As illustrated, the toner held in a toner tank (to be referred as 'hopper' hereinbelow) is conveyed near to a developer support (to be referred to as 'developer roller' hereinbelow) 100 by an agitator or screw.

Put in pressing contact with developer roller 100 is a toner supply roller 200, which turns in the same direction as developing roller 100, that is, the surfaces of the two rollers at their opposing portions move in the opposite directions.

Toner supply roller 200 has a voltage applied from bias power supply 210, the voltage being set so as to electrostatically push the toner toward developer roller 100. For example, if the toner is of a negative charged type, a bias voltage having a greater value towards the negative side is applied. The toner which has been tribo-electrified by toner supply roller 200 and brought to the developer roller 100 by the function of the bias voltage, is conveyed by the rotational action of developer roller 100 to the position where the toner layer metering blade (which may also be referred as 'blade') 300 abuts the toner. Blade 300 is formed of a metal sheet and is pressed on its distal end or the flat portion near the distal end of the blade against developer roller 100. The toner on developer roller 100 is controlled by the predetermined pressure and set position of the blade so as to have a desired amount of charge with a desired thickness and conveyed to the developing area (where the toner opposes a photoreceptor 51 having a static latent image formed thereon) for the developing step.

Undeveloped toner on developer roller 100, which was not used in the developing step, goes back to the developer unit. That is, the toner on developer roller 100 is removed of its static charge by means of a charge erasure device (means) 400 located after the developing area and before toner supply roller 200 and then separated and collected from the developer roller by abutment at the entrance of toner supply roller 200, and reused.

Specific device configurations of the embodiment of a developer unit to which the present invention is applied are shown in Table 1.

TABLE 1

A configurational example of a mono-component developer unit

| Component | Photo-receptor 51 | Developer roller 100 | Supply roller 200 | Toner layer metering blade 300 |
|---|---|---|---|---|
| Material | OPC | Conductive urethane | Conductive urethane (sponge) | Stainless steel |
| Diameter (mm) | 30 | 20 | 16 | Thickness 0.1 |
| Resistivity (Ω cm) | — | about $10^6$ | about $10^5$ | — |
| Hardness (degree) | — | 70 (JIS A) | 68 (Asker F) | — |
| Bias Voltage (V) | (Dark potential) −550 | −300 | −400 | −400 |
| Peripheral speed(mms/s) | 150 | 225 | 133 | — |

With the conductive base connected to an electric ground, photoreceptor 51 is charged at a surface potential of −550 V, and is a negatively charged drum having a diameter D3 of 30 mm, rotating at a peripheral speed Va of 150 mm/s in the direction of the arrow in FIG. 1.

Developer roller 100 is a conductive elastic roller and is made up of a cylindrical element covered by conductive urethane rubber containing a conductor agent such as carbon black etc., with a volume resistivity of about $10^6$ Ωcm and a JIS-A hardness of 60 to 70 degrees. This roller has a diameter Db of 20 mm and rotates at a peripheral speed Vb of 225 mm/s in the direction arrow in FIG. 1. This developer roller 100 has a conductive support shaft(made up of stainless steel, conductive resin or the like) having a diameter Ds of 10 mm, and has a voltage E1 of −300 V applied from a developing bias power supply 110 via this support shaft. Developer roller 100 is set in contact with photoreceptor drum 51 with a toner layer in between so as to create a developing nip of about 1.5 mm wide.

Toner supply roller 200 has the functions of toner agitation and toner removal after development and is made up of conductive foamed urethane having a volume resistivity of about $10^5$ Ωcm, cellular density of about 3 cells/mm, with a diameter of 16 mm. This toner supply roller is set in contact with developer roller 100 with a contact depth of 0.5 to 1 mm and turns at a peripheral speed Vc of 133 mm/s. This toner supply roller 200 has a voltage E2 of −400 V applied from a supply bias power supply 210 via its support shaft, as the conductive support (made up of stainless steel, conductive resin, or the like).

The non-magnetic mono-component toner, which was negatively charged beforehand by supply roller 200 and has transferred to developer roller 100 surface is carried by the rotation of developer roller 100 to the position where toner layer metering blade 300 abuts the toner.

Toner layer metering blade 300 is a conductive plate-like element (made up of stainless steel, phosphor bronze, conductive resin, or the like) which is of 0.1 mm thick and has a cantilever leaf spring configuration with a free end on its upstream side with respect to the rotational direction of developer roller 100 while abutting developer roller 100 at a linear pressure of 15 to 30 gf/cm. Toner layer metering blade 300 has a voltage E3 of −400 V applied from a bias power supply 390.

The toner layer on developer roller 100 is regulated by toner layer metering blade 300 so that the amount of toner adherence is adjusted to about 0.6 to 0.8 mg/cm$^2$ and the amount of charge on the toner to about −10 to −15 μC/g, and then is conveyed by the rotation of developer roller 100 to the developing area where the toner opposes and comes into contact with photoreceptor 51, to effect contact reversal development.

Toner charge erasure means 400 has the function of a seal for prevention of toner leakage from the bottom of the developer roller 100 as well as having the function of removing charge from the undeveloped toner on developer roller 100 after development. This toner charge erasure means 400 is made up of a conductive film of 0.2 mm thick, is set at a potential equal to developer roller 100 or at a voltage higher by about +50 V than that of the developer roller by a bias power supply 410 for toner charge erasure, with its conductive surface abutted against developer roller 100.

Toner charge erasure means 400 may be of a conductive member such as an aluminum deposited film etc. Alternatively, if there is no need for the removal of toner charge, a Mylar is film or the like may be used in order to seal the bottom. In this case, no bias power supply 410 for toner charge erasure is needed.

The toner used here is a so-called, high-resistance toner. The toner in the form of pellets has an electrical resistance of about $10^{10}$ Ωcm, and is produced by mixing and kneading 80 to 90 parts by weight of polyester resin or styrene-acrylic copolymer as the base resin and about 4 to 10 parts by weight of carbon black, blending 0 to 5 parts by weight of charge control agent (CCA) and a suitable (slight) amount of vulcanization control agent to the mixture, and adding about 0.2 to 2 parts by weight of silica as an external additive after crushing.

Next, the embodiments of the present invention will be explained with reference to the drawings.

The First Embodiment

Figure 2:
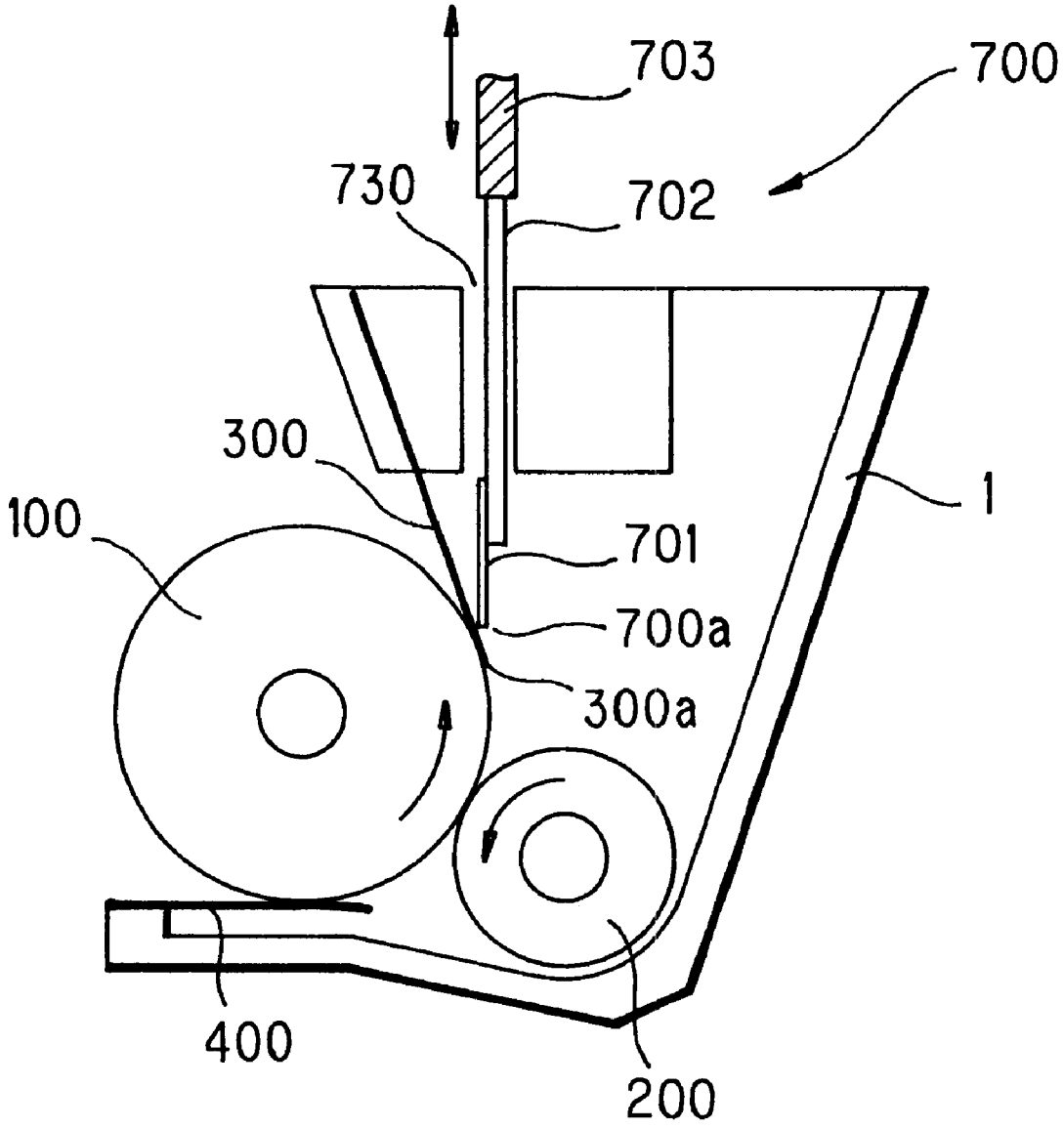
FIG. 2 is a schematic sectional view showing the developer unit having a cleaning tool of the first embodiment.
Figure 3:
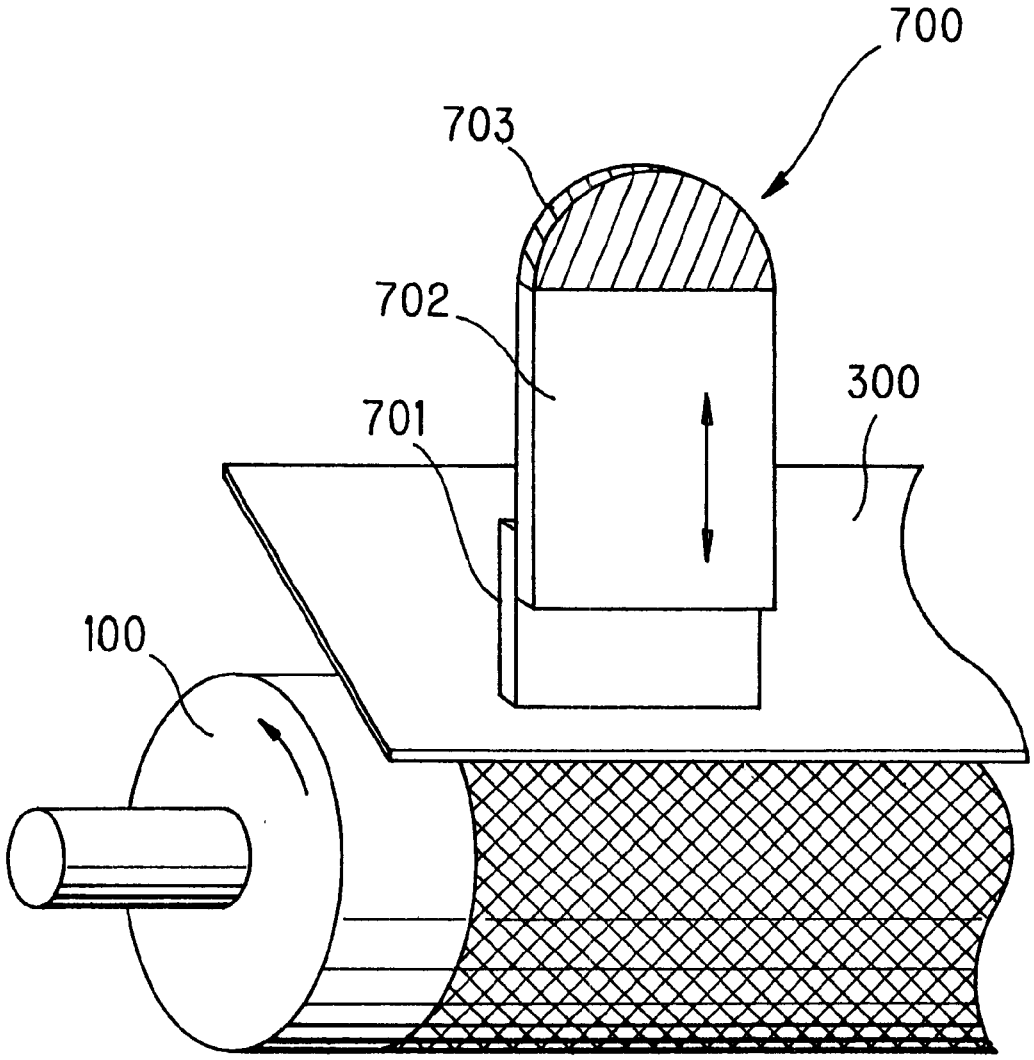
FIG. 3 is a schematic view showing the cleaning tool.

FIG. 2 is a schematic sectional view showing a developer unit of the first embodiment. FIG. 3 is a schematic view of a toner layer metering blade, viewed from its rear side.

This embodiment involves a cleaning portion which is adapted to frictionally slide from the fixed end to free end of blade 300 in the width direction thereof. As illustrated, cleaning portion 700 is comprised of: a resin-made support element 702 of 1 mm thick having a high enough rigidity; a cleaning element 701 made up of PET(polyethylene terephthalate) Mylar of 0.2 mm thick and of a rectangle having a side of some tens millimeters, attached on the blade side of support element 702 so that its distal end projects; and a handle 703 arranged on the upper part of support element 702.

This cleaning portion 700 is inserted through a longitudinal slit 730 formed in a developer hopper 1 into the interior of the developer hopper and is adapted to move up and down by moving handle 703 up and down so that the cleaning element will slide along the backside of toner layer metering blade 300 which is arranged inclined.

Next, the operation of cleaning portion 700 will be described. As cleaning portion 700 is moved down, its distal part 700*a* soon abuts the backside of blade 300. A further downward movement makes the distal part resiliently follow along the backside of blade 300 and move down. The distal end of cleaning portion further moves downwards passing by the blade edge, designated at 300*a*, which is located close to the abutment position of blade 300 against developer roller 100.

Distal part 700*a* of cleaning portion 700 cleans blade edge 300*a* by scraping the toner off from the proximal side of the blade. This cleaning action is made continuously across the full length of the blade to clean the whole blade.

The toner supplied from toner supply roller 200 upstream of the blade 300 with respect to the rotational direction of developer support 100 is regulated as to its layer thickness by the blade edge, so that excessive toner goes back to the developer hopper. Some toner will adhere to the blade edge area after time passes as the apparatus is used. No problem arises if the toner exchanged to a high degree, but there are cases where the same cluster of toner remains for a long time. Once a cluster of toner stops moving, the toner is unlikely to be exchanged, and liable to remain to indefinitely. Such stationary toner is continuously compressed by the powder pressure of the toner and hence adheres to the blade whilst being rather heavily packed since the toner successively flows in from the upstream side to be regulated by the blade. Conversely, once compressed and packed, the toner will not be exchanged any more.

Therefore, the toner stuck to the blade should be removed by the downward movement of cleaning portion 700 so as to be released into the circulating toner. In this case, the toner to be removed is of a rather compressed mass and may be being unified with the toner adhering to the blade abutment surface and packed thereon. As the cleaning element slides abrasively along the backside of the blade edge to remove the toner stuck to the blade backside, it becomes possible to remove the toner stuck on the blade abutment surface, en bloc.

In this case, if the stationary toner is not too compact or not firmly united so as not to be unified with the stuck buildup on the blade abutment side, the toner adhering on the blade backside will be removed alone. Even in this case where the stuck buildup on the abutment side cannot be removed, this is not the level that will directly cause image degradation since the compactness is low. Therefore, there is no concern as long as the buildup on the abutment side can be removed by the next cleaning operation.

On the other hand, there are cases where not only toner has been merely compressed and packed on the blade abutment surface, but has been transmuted by heat, pressure and other factors and firmly stuck to the blade, forming sticky grown buildup. In such cases, stuck buildups have grown up, being projected from the blade edge, so part of them can be also seen from the backside edge of the blade (in practice, they cannot be seen because they are buried in the circulating toner). When the buildups are removed from the blade backside by cleaning portion 700, the stuck buildups can be removed altogether.

Particularly in the case of the present embodiment, blade 300 is arranged in a leading directional configuration, so that stuck buildups generally continue to be pressed from the upstream side by the rotation of the developer roller. Since the cleaning element is moved by sliding abrasively from the downstream side to the upstream side, the stuck buildups are liable to be removed en bloc. Of course, the effect of unified removal of stuck buildups can be obtained even with a trailing directional configuration.

In the above way, it is possible to obtain proper cleaning effect even when adherence has progressed too far. However, stationary toner is preferably removed before the progress of sticking so as to retard the emergence of sticking itself.

Table 2 below represents the print test results showing the effects of the cleaning method of this embodiment. That is, print tests were conducted for the case where cleaning was carried out by the cleaning method of the this embodiment, for the case where no cleaning was carried out, for the case where cleaning was carried out by inserting a cleaning element, identical with that of this embodiment, into the gap between developer roller 100 and toner layer metering blade 300 of the prior art developer unit and making the blade move forward and backward along the developer roller axis. In the table, unit 'k' represents 1000 printouts, 'every 1k' indicates that cleaning was carried out for every 1000 printouts, 'every 5k' indicates that cleaning was carried out for every 5000 printouts. The table further shows whether white lines were found and whether white lines were eliminated during cleaning (before/after cleaning) at 5k(5000 printouts), 10k(10000 printouts), 15k(15000 printouts) and 20k(20000 printouts) for the above cases.

Table 2

Printout number vs. the number of white line(image voids) defects occurring(before/after cleaning)

| | | Start | 5k | 10k | 15k | 20k |
|---|---|---|---|---|---|---|
| 1st embodiment | every 1k | 0 | 0/0 | 0/0 | 0/0 | 1/0 |
| | every 5k | 0 | 1/0 | 2/0 | 1/0 | 3/0 |
| 7th embodiment | every 1k | 0 | 0/0 | 0/0 | 1/0 | 1/0 |
| | every 5k | 0 | 1/0 | 1/0 | 2/0 | 2/0 |
| By sliding the Mylar sheet inserted between the blade and developer roller (in the prior art example) | every 1k | 0 | 0/0 | 0/0 | 1/0 | 0/0 |
| | every 5k | 0 | 0/0 | 2/0 | 3/2 | 5/3 |
| No cleaning | | 0 | 1 | 3 | 8 | 14 |

Note: the above number indicates the number of white lines occurring due to toner sticking to the blade or clogging of foreign substances.
In the method of sliding the Mylar sheet inserted between the blade and developer roller, image smearing of the developer roller pitch due to damages to the developer roller surface occurred. More image defects of this type were found for the same number of printouts as in the case of cleaning every 1 k.

As understood from Table 2, use of the configuration of this embodiment makes it possible to obtain good images free from white lines for a long period of time. It is also understood that periodic cleaning is effective. For comparison, evaluation was made by effecting the cleaning method of inserting an identical cleaning element(PET film of 0.2 mm thick and 20 mm wide) into the gap between the developer support and the abutment surface of toner layer metering blade and completing a manual cycling movement of the blade along the longitudinal direction of the developer support.

As to this method, it was not easy to insert the cleaning element between the developer support and the toner layer metering blade pressed against the support and slide it. Further, sliding movement of the cleaning element inevitably damaged the developer support surface. Performance of frequent cleaning makes it possible to prevent image degradation due to stuck toner but results in a higher possibility of the developer roller being damaged. Because of use of a cleaning element made up of Mylar, it was difficult to completely remove the buildups after sticking had matured.

In contrast, for the present embodiment, sliding movement could be done relatively easily and stuck toner could be removed effectively by rubbing the blade backside. Image smearing due to damages to the developer roller surface did not arise.

Though the cleaning element used in this embodiment is rather short in length, i.e., the dimension in the longitudinal direction of the blade, compared to the blade, a cleaning element longer than this maybe used. In this case, one cleaning action makes it possible to clean a broader range of the blade, leading to improvement in efficiency. Needless to say, a cleaning element having a length approximately equal to that of the blade will produce a good result.

Though PET Mylar of 0.2 mm thick is employed by the cleaning element 701 of this embodiment, the thickness and material should not be limited but various thicknesses and various materials can be used as long as they present the necessary spring elasticity(flexibility). For example, metals such as stainless steel, phosphor bronze and the like may be used. Alternatively, flexible materials such as rubber, resin and the like may be employed. Combination of these, such as a metal plate with rubber applied as a tip, may also be possible.

Figure 4A:
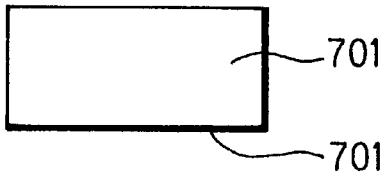
FIGS. 4A to 4F are diagrams showing cleaning elements in a variety of shapes.
Figure 4D:
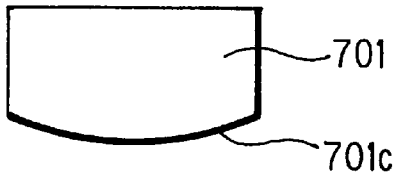
Figure 4B:
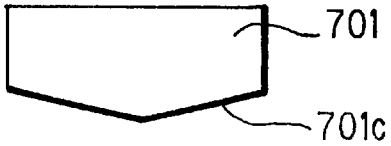
Figure 4E:
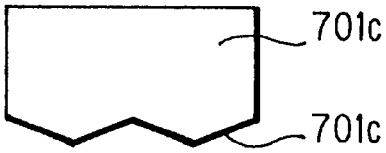
Figure 4C:
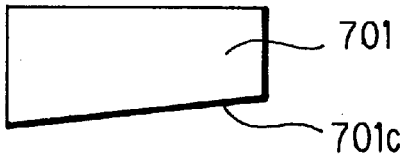
Figure 4F:
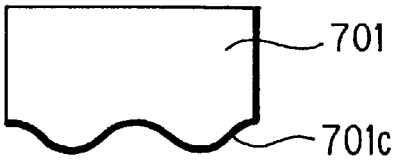

In the present embodiment, cleaning element 701 of a rectangle as shown in FIG. 4A is used, but other shapes as shown in FIGS. 4B to 4F may be possible. It is possible to employ any cleaning element having a polygonal shape with its free end side projected at the center as shown in FIG. 4B, a trapezoidal shape with its free edge 701*c* projected on one side than on the other as shown in FIG. 4C, a shape with its free end arched outward as shown in FIG. 4D, a shape with its free end jagged as shown in FIG. 4E, or a shape with its free end wavy as shown in FIG. 4F.

In the above cases, the distal end of cleaning element 701 will not abut the blade edge at the same time, the force concentrates on the abutment point, enabling efficient removal of buildups. Since the abutment point or area on the blade edge continuously moves as the cleaning element moves down, the buildups can be removed successively. During this process, since the force will act on buildups from the side where removal has been done, buildups can be readily peeled off. Also in this case, the cleaning element may be long in the longitudinal direction of the blade and needless to say, a cleaning element having a length approximately equal to that of the blade will be well suited.

Figure 5:
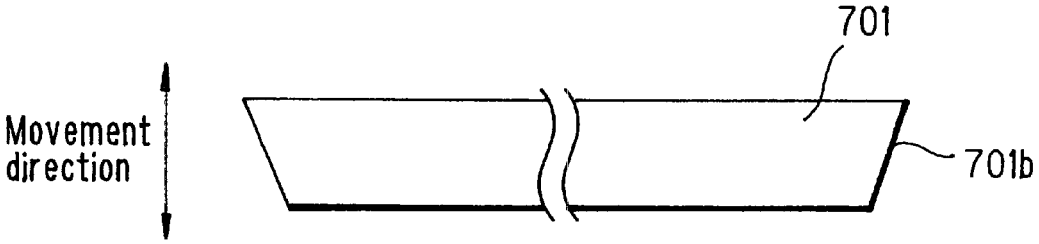
FIG. 5 is a diagram showing another cleaning tool in a practical shape.

As shown in FIG. 5, it is preferred that side edges 701*b* at both ends of cleaning element 701 with respect to the horizontal direction be inclined with respect to the cleaning element's direction of movement. This manipulation prevents the side edges or ridgelines from abrasively rubbing the fixed points when the cleaning element is moved up and down, thus making it possible to avoid damages to the developer roller and the blade edge.

Figure 6A:
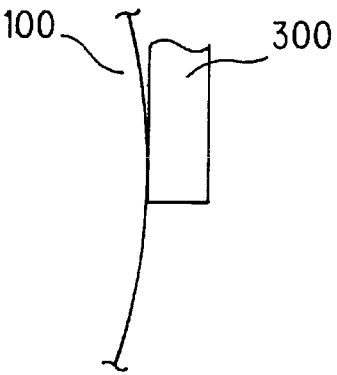
FIGS. 6A to 6E are sectional views showing toner layer metering blades in a variety of tip shapes.
Figure 6B:
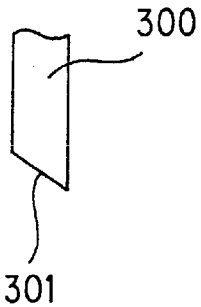
Figure 6C:
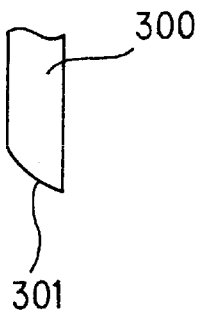
Figure 6D:
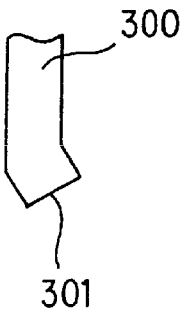
Figure 6E:
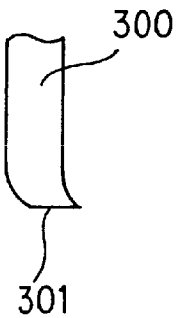
Figure 7A:
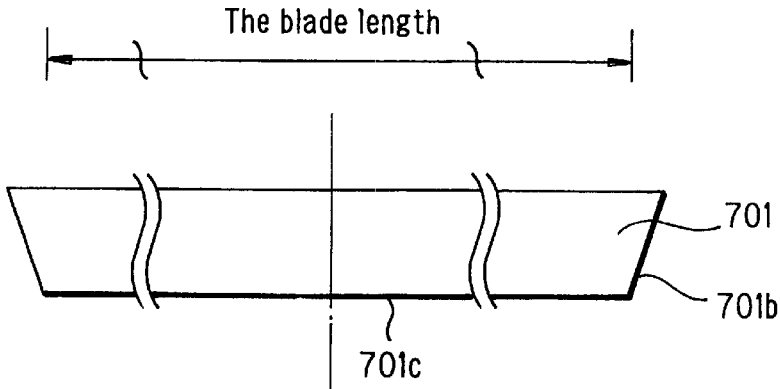
FIGS. 7A to 7D are schematic diagrams showing cleaning elements of the second embodiment in a variety of shapes.
Figure 7B:
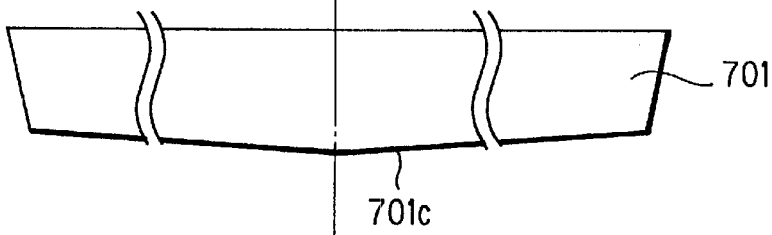
Figure 7C:
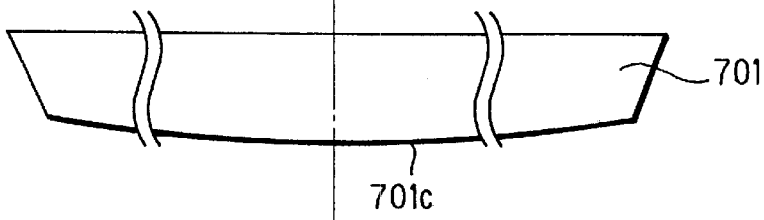
Figure 7D:
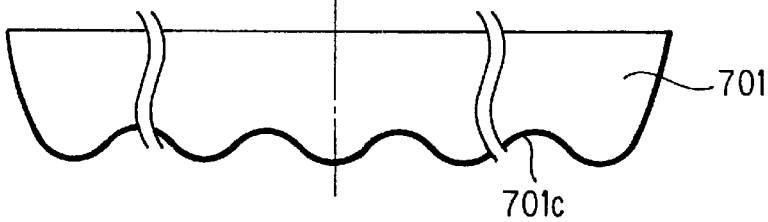

The sectional tip shape of toner layer metering blade 300 may be one which is not particularly shaped as shown in FIG. 6A, the blades 300 having inclined portions 301 at their tip shown in FIGS. 6B to 6E will work effectively with the cleaning method of this embodiment. Illustratively, the blade may have a variety of shapes such as having a linearly inclined tip section as shown in FIG. 6B, an outwardly arched, inclined tip section as shown in FIG. 6C, an inclined tip bent outwards as shown in FIG. 6D and an inclined tip curved outwards as shown in FIG. 6E. In the configuration where the distal edge or therearound of a plate-like, toner layer metering blade 300 of any of the above types abuts the developer roller surface, use of the cleaning element of the present embodiment makes it possible to effectively remove stuck toner.

The Second Embodiment

FIGS. 7A to 7D are schematic diagrams showing cleaning elements 701 of the second embodiment in a variety of shapes. Each of these cleaning elements 701 is approximately equal in length to blade 300 while each cleaning element is formed symmetrically or has the same width at corresponding points on the left and right sides with respect to the medial line lying along the rotational direction of the developer roller. Each of cleaning elements 701 of this embodiment has inclined side edges or ridgelines 701*b* as shown in FIG. 5. Free ends 701*c* correspond to that shown in FIGS. 4A, 4B, 4D and 4F, respectively.

With the above configuration, the cleaning effect on blade 300 is also symmetrical. Since forces acting on cleaning element 701 when the element scrapes the blade edge portion is also symmetrical with respect to the axis of symmetry, distortion due to the forces is canceled out so that beneficial scraping and cleaning can be obtained. Since the cleaning effect is symmetrical on the left and right sides, image defects occurring in case of cleaning unevenness will be inconspicuous.

The Third Embodiment

Figure 8:
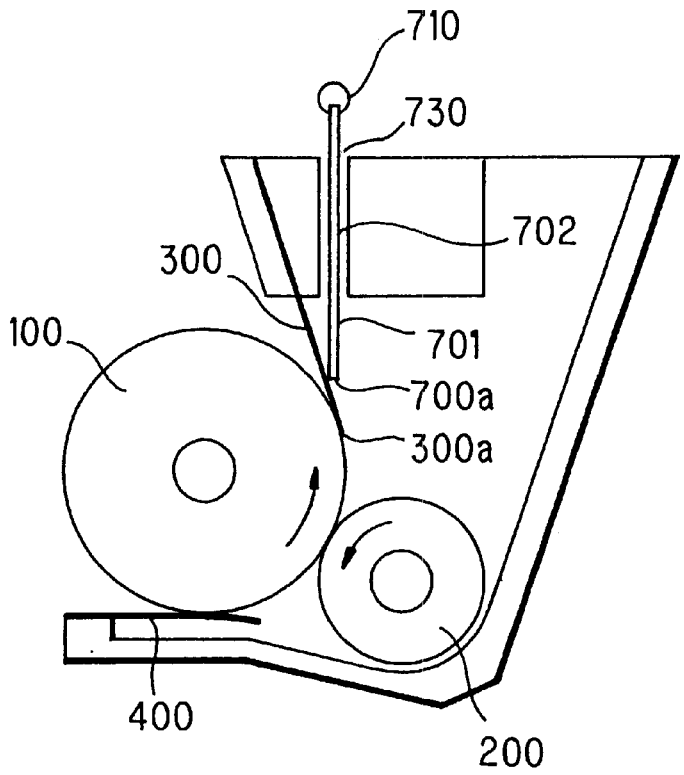
FIG. 8 is a schematic diagram showing a developer unit in accordance with the third embodiment of the present invention.

FIG. 8 is a schematic diagram showing a cleaning portion 700 of the third embodiment. This cleaning portion 700 is composed of a first support element 702 made up of resin with a Mylar sheet 701 of 0.2 mm thick and being approximately equal in length to the blade, applied at the distal edge of first support element 702. The first support element 702 is arranged to pass through slit 730 formed in developer hopper 1 and is fixed to a second support element 710 outside the developer hopper.

Figure 9:
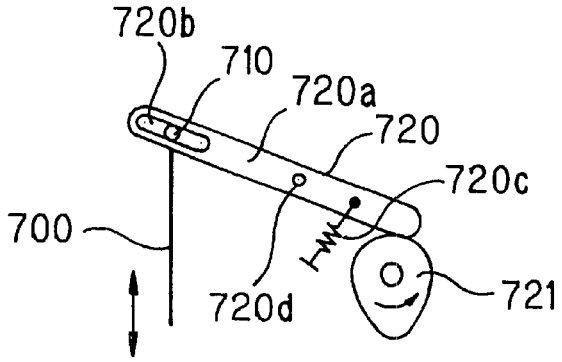
FIG. 9 is a diagram showing a cleaning tool drive mechanism of the same embodiment.

Second support element 710 is extended to both sides in the longitudinal direction of the blade and the extensions are supported by a linkage mechanism 720 at both sides of the developer hopper as shown in FIG. 9 and linked with a cam 721 rotated by an unillustrated drive means.

Link mechanism 720 is comprised of a rod-like link 720*a* rotating about its center or an axle 720*d*, a slot 720*b* formed on one side of the link and having the extension of second support element 710 fitted therein and a spring 720*c* coupled at the other end of the link and urging link 720*a* upward. The cam surface of cam 721 is put in contact with the other end of link 720*a*.

In the driver device of cleaning portion 700 that employs cam 721 and link mechanism 720, cleaning element 701 moves up and down as the cam rotates. As cleaning element 701 moves down by the action of the cam and link mechanisms, distal part 700*a* of cleaning element 701 soon abuts the backside of the blade. A further downward movement causes the distal part to follow due to its resiliency (flexibility) along the backside of blade 300 and move downwards. The distal end of cleaning portion further moves downwards passing by the blade edge, designated at 300*a*, which is located close to the abutment position of blade 300 against developer roller 100.

During this movement, distal part 700*a* of cleaning element 701 cleans blade edge portion 300*a* by scraping the toner off from the proximal side of the blade. Cleaning element 701 is usually set at high enough a retracted position compared to that of cam 720*a*.

The Fourth Embodiment

Figure 10A:
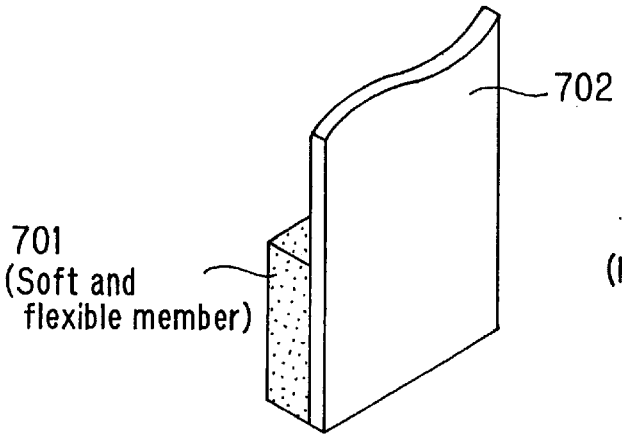
FIGS. 10A and 10B are perspective views showing cleaning portions of the fourth embodiment.

FIG. 10 shows cleaning portions of another embodiment of the present invention. As shown in FIG. 10A, cleaning portion 700 is comprised of a support element 702 having spring elasticity, made up of metal, resin or the like and a cleaning element 701 of a pad made up of felt or the like, affixed to the support element. This cleaning portion 700 is applied to the developer units of the first and second embodiments.

Support element 702 is extended through slit 730 formed in developer hopper 1 into the developer hopper so that the pad-like cleaning element 701 attached to the distal edge presses the distal part of the blade from the backside thereof. The cleaning element is slid manually or by a drive mechanism such as a cam device to remove stuck buildups on the abutted edge of the blade.

Cleaning portion 700 may be configured so that it can be detached at a predetermined position of the developer hopper or may be configured so that it can be retracted into the non-image area with its pressure onto the blade edge part released.

Figure 10B:
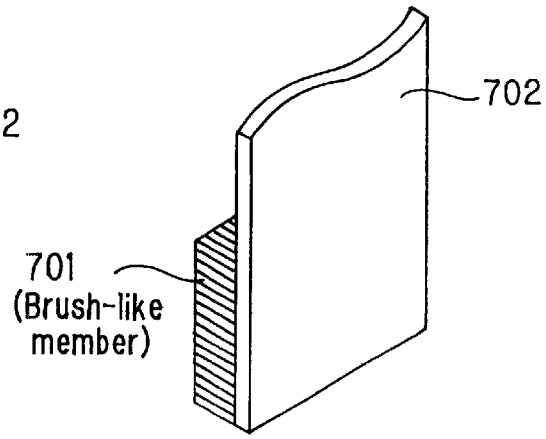

Instead of pad-like cleaning element 701, a brush-like element as shown in FIG. 10B may be employed. The brush can use chemical fiber fabric such as nylon, rayon etc, with a preferable diameter of 0.1 to 0.5 mm. Instead of felt pad 701, a rubber plate element of urethane rubber, silicone rubber, etc may be employed.

The Fifth Embodiment

Figure 11:
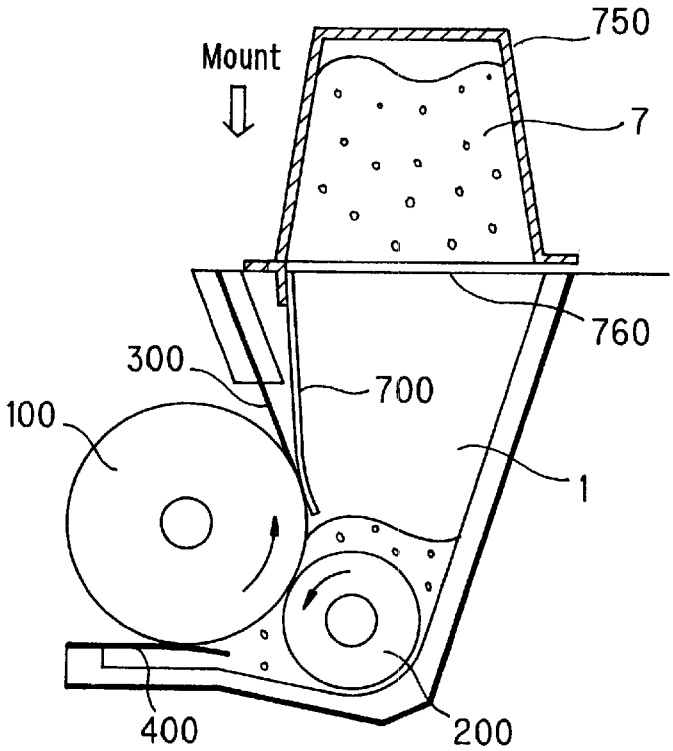
FIG. 11 is a schematic sectional view showing a developer unit in accordance with the fifth embodiment.

FIG. 11 is a schematic view showing a developer unit of the fifth embodiment. This developer unit has a configuration where upon consumption of the toner inside developer hopper 1 to a lower level, the toner hopper is replenished with fresh toner by mounting a toner container cartridge 750 holding fresh toner over the developer hopper and pulling a bottom seal 760 out from the toner container cartridge.

This toner container cartridge 750 has a cleaning portion 700 made up of a PET sheet of 0.2 mm thick, projected downward. When toner container cartridge 750 is mounted from above to developer hopper 1, this cleaning portion 700 enters the hopper along the backside of blade 300 and reaches beyond the lower edge of the blade whilst abrasively cleaning the blade backside.

Cleaning portion 700 is integrated with bottom seal element 760 enclosing the bottom opening of toner container cartridge 750 so that it can be pulled out together when seal element 760 is pulled out and the fresh toner is replenished.

The Sixth Embodiment

Figure 12:
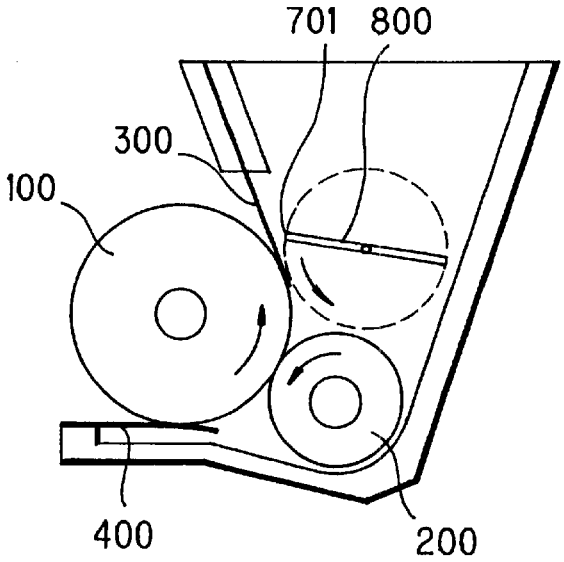
FIG. 12 is a schematic sectional view showing a developer unit in accordance with the sixth embodiment.

FIG. 12 is a schematic sectional view showing a developer unit of the sixth embodiment. The toner in developer hopper 1 is periodically or a periodically agitated by rotation of a agitator vane 800. A cleaning element 701 made of urethane rubber of 0.5 mm thick is attached to the distal part of agitator vane 800 so that it rubs and cleans the distal part of the blade as agitator vane 800 rotates.

Thus, a simple device, that is, provision of agitator vane 800 enables cleaning of the blade. Since the cleaning is performed when the toner is agitated, the blade can be cleaned at intervals of a relatively short period hence toner can be prevented from sticking.

Though cleaning element 701 of this example uses urethane rubber of 0.5 mm thick, the material and thickness should not be limited to this and can be selected as appropriate as long as it is effective.

The Seventh Embodiment

Figure 13:
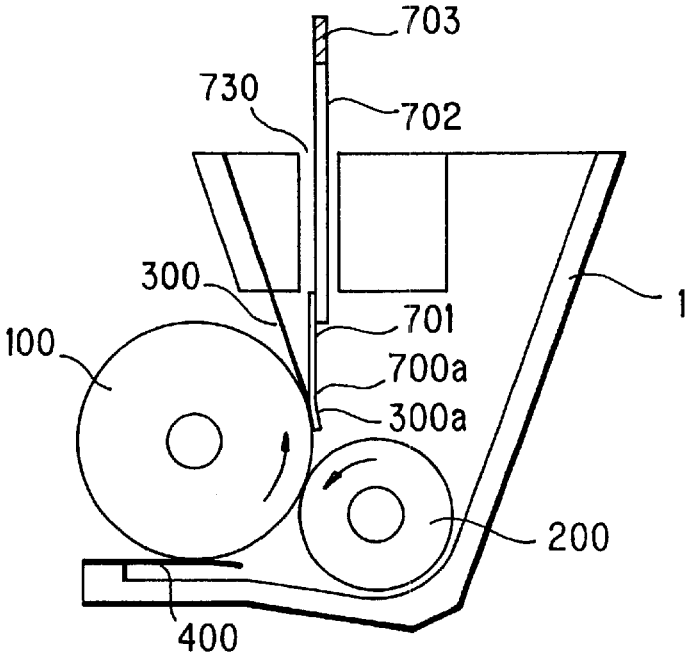
FIG. 13 is a schematic sectional view showing a developer unit in accordance with the seventh embodiment.
Figure 14:
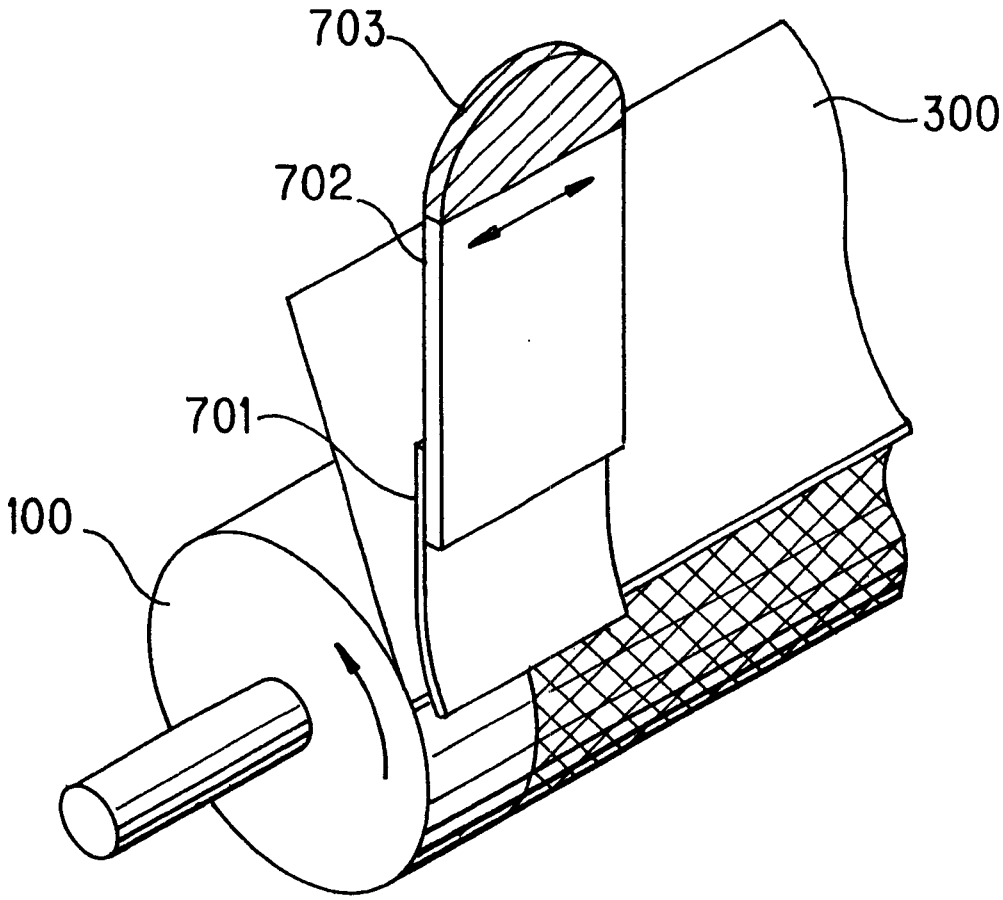
FIG. 14 is a perspective view showing the cleaning tool of the same embodiment, viewed from the rear side of the toner layer metering blade.

FIG. 13 is a schematic sectional view showing a developer unit of the seventh embodiment and FIG. 14 is a perspective view of the same embodiment viewed from the rear side of the toner layer metering blade. This embodiment, differing from the above first through sixth embodiments, is of a type which cleans the blade by frictionally sliding the cleaning element in the blade lengthwise direction.

A cleaning portion 700 is comprised of: a resin-made support element 702 of about 1 mm thick having a high enough rigidity; a cleaning element 701-made up of PET Mylar of 0.2 mm thick and of a rectangle having a side of some tens of millimeters, attached on the blade side of support element 702 so that its distal end projects outwards from the distal edge of blade 300; and a handle 703 arranged on the upper part of support element 702.

This cleaning portion 700 is inserted through a longitudinal slit 730 formed in a developer hopper 1 into the interior of the developer hopper and is adapted to slide in the longitudinal direction by means of handle 703. The cleaning element may be driven to move side to side by a motor which reciprocates a timing belt wound between two pulleys arranged at both ends or by reciprocation of a cylinder etc. Further, these mechanisms may be combined with a publicly known vibration generator which vibrates cleaning element 701.

In the above configuration, since cleaning element 701 rubs the backside of distal part 300*a* of toner layer metering blade 300, no damage is given to developer roller 100 and the surface of toner layer metering blade 300 as well. Thus, it is possible to remove the stuck toner from toner layer metering blade 300 without risk. As shown in FIGS. 13 and 14, in cleaning portion 700, the portion which actually scrapes stuck toner is formed with a thin cleaning element 701, whereby it is possible to improve the efficiency of scraping the stuck toner. Here, the backside and front side of toner layer metering blade 300 are referred to on the basis that the surface opposing developer roller 100 is the front.

In this embodiment, though cleaning portion 700 is provided as a three-piece configuration where support element 702 and handle 703 are joined to thin, plate-like cleaning element 701, the cleaning portion may be provided as a one-piece configuration where cleaning element 701, support element 702 and handle 703 are integrated as long as the structure has an adequate rigidity withstanding the sliding movement in the longitudinal direction of the blade. In this case, the number of parts can be reduced, leading to a reduction in cost.

Table 2 represents the print test results showing the effects of the cleaning method of this embodiment. That is, print tests were conducted for the case where cleaning was carried out by the cleaning method of this embodiment, for the case where no cleaning was carried out, for the case where cleaning was carried out by inserting a cleaning element (Mylar), identical with that of this embodiment, into the gap between developer roller 100 and toner layer metering blade 300 of the prior art developer unit and making the blade move forward and backward along the axis of developer roller 100. The present embodiment showed results similar to that in the first embodiment, that is, good images free from white lines were obtained for a long period.

The Eighth Embodiment

FIGS. 15 to 21B are diagrams showing a variety of cleaning elements 701. First, FIGS. 15 to 17C show examples of cleaning elements 701, applied to the lower end of support element 702, with sloping tabs 705 on both sides thereof. In these figures, the hatching indicates the overlap areas for application.

Cleaning element 701 may have a straight section as that shown in FIG. 14 to produce the necessary effect of removing buildups. However, when the cleaning element is provided with slopes at both sides thereof, with respect to the blade lengthwise direction, in the direction of movement so that the side edges will frictionally slide along the backside of blade 300, a further enhanced buildup removal effect can be expected.

Figure 15:
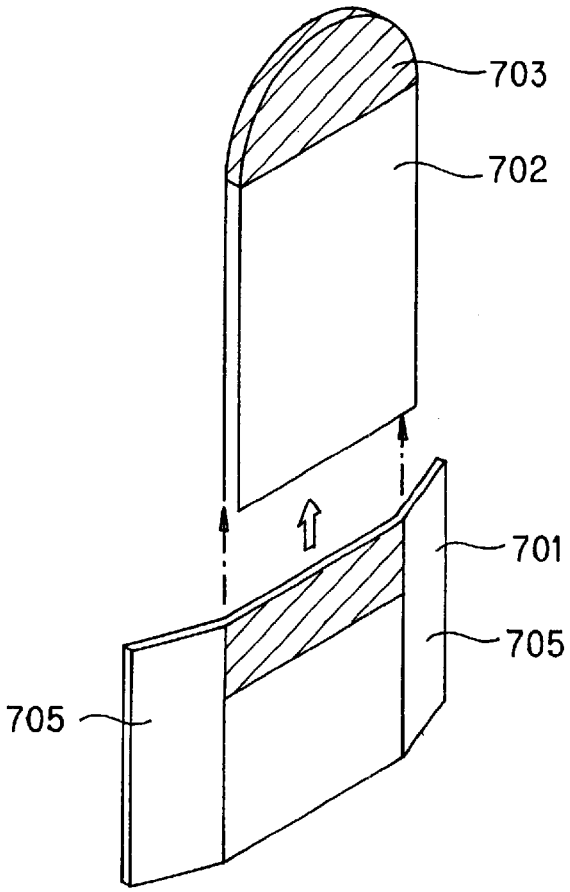
FIG. 15 is a perspective view showing an example of a cleaning element with sloping tabs at both ends in accordance with the eighth embodiment.
Figure 16:
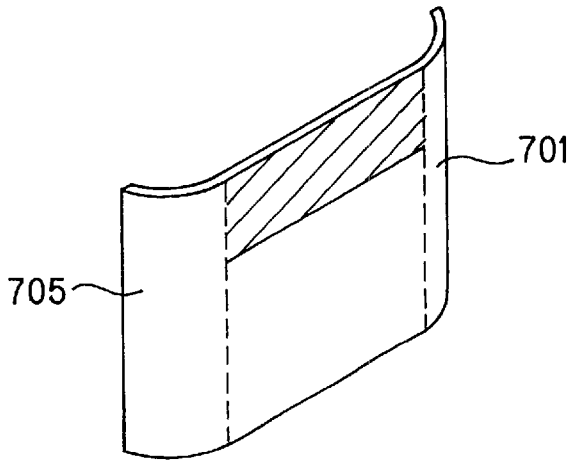
FIG. 16 is a perspective view of the same embodiment showing another variation of a cleaning element with sloping tabs.
Figure 20:
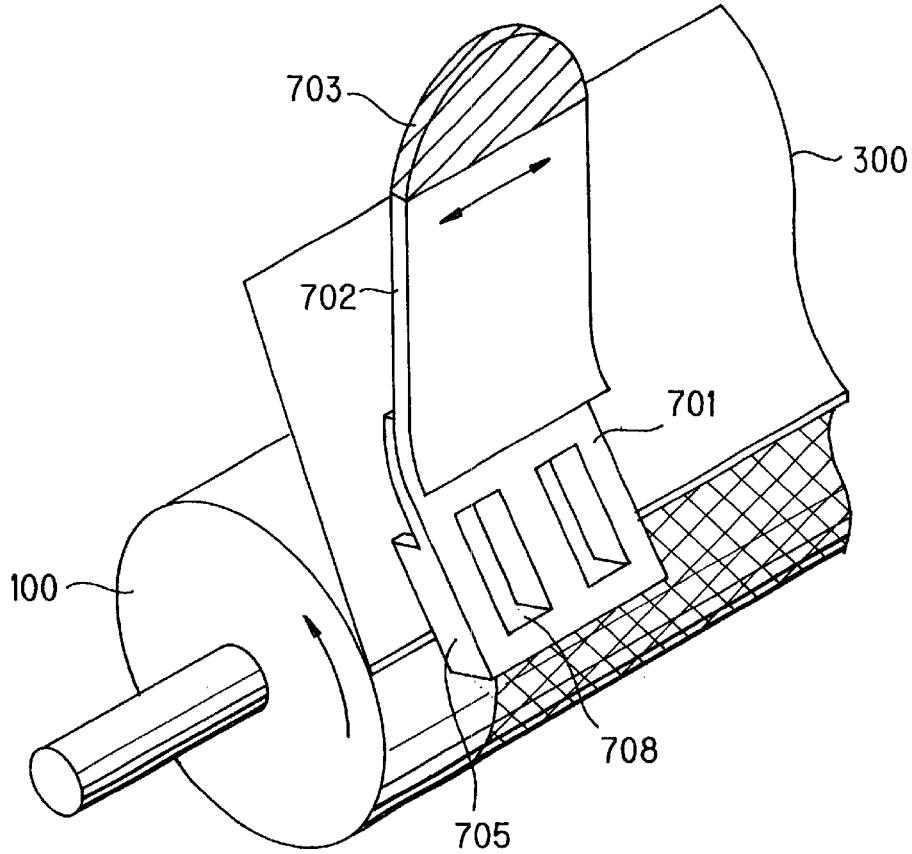
FIG. 20 is a perspective view showing a cleaning element of the same embodiment with sloping tabs and slots formed therein, viewed from the rear side of the blade.
Figure 21A:
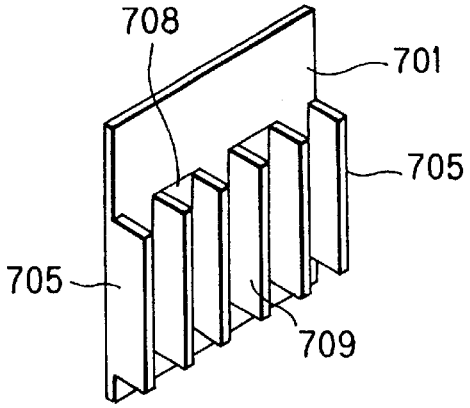
FIGS. 21A to 21B are perspective views of the same embodiment showing examples of cleaning elements with slots and jagged portions formed therein.

As examples of the slopes, sheet-like cleaning element 701 may be formed with obtusely angled tabs 705 at both sides thereof as shown in FIG. 15, or may be formed with curved tabs 705 at both sides thereof as shown in FIG. 16. Further, as shown in FIGS. 20 and 21A, both sides may be bent at right angles to form sloping tabs (flexed tabs) 705.

In accordance with the above configurations, the effect of removing buildups can be promoted as well as the strength and rigidity of cleaning element 701 are enhanced. 'Sloping tab' mentioned in this embodiment is assumed to include that bent at right angles, as shown in FIG. 20.

Figure 17A:
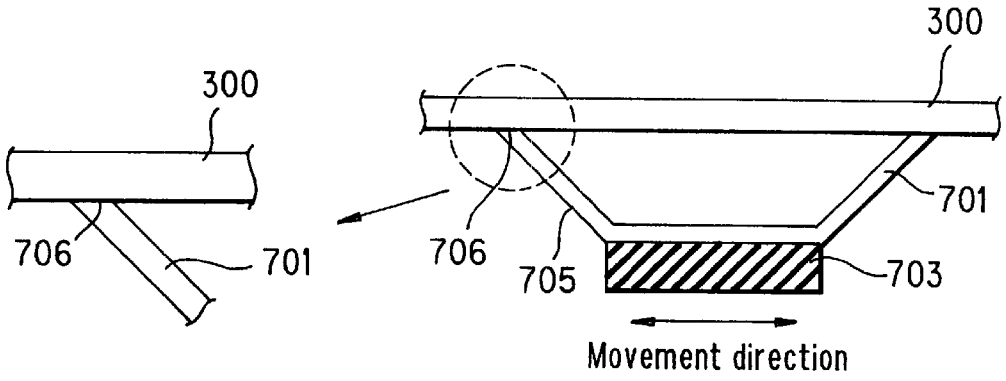
FIGS. 17A to 17C are diagrams showing of the same embodiment inclined portions in a variety of tip edge shapes.
Figure 17B:
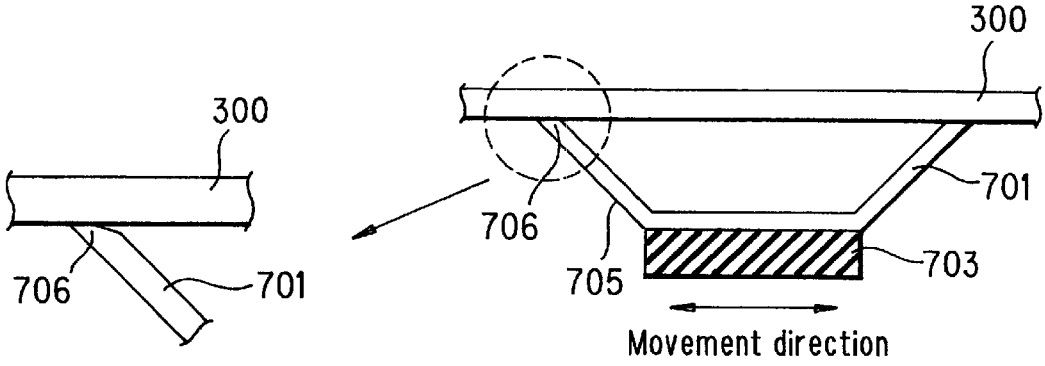
Figure 17C:
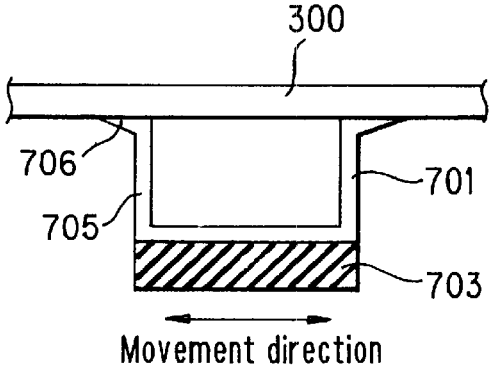

Concerning the shape of the distal edge of sloping tab 705, other than that particularly unshaped, the edge portion, designated at 706, may be cut along the contact angle with toner layer metering blade 300 forming a knife-edge configuration, as shown in FIG. 17A. Alternatively, it is preferred that the edge may be formed with a knife-edge configuration which will come in point contact with toner layer metering blade 300 or share a smaller contact area with the blade, as shown in FIG. 17B. Further, in the case where cleaning element 701 is formed with tabs bent at right angles, it is possible to employ wedge-shaped edge portion 706 as shown in FIG. 17C which is thick at the proximal side and is tapered to a distal edge toward the direction of movement. In either case, the buildup removal effect can be enhanced.

Figure 18A:
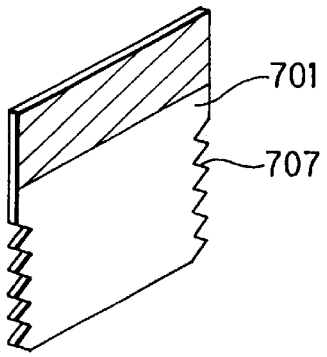
FIGS. 18A to 18C are perspective views of the same embodiment showing cleaning elements in a variety of Jagged configurations at both side edges thereof.
Figure 18B:
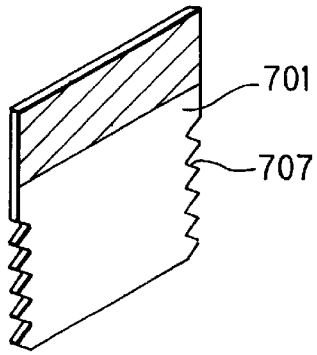
Figure 18C:
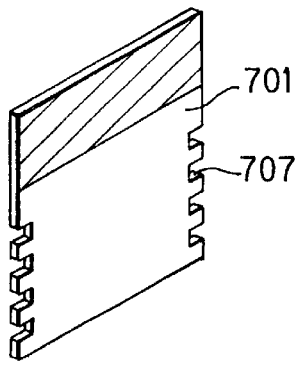

FIGS. 18A to 18C are perspective views showing thin sheet-like cleaning elements 701 with a variety of jagged edges 707 at both side edges thereof. Provision of such jagged edges 707 is able to enhance the buildup removal effect.

Examples of jagged edges 707 at the edge portions on both sides of thin sheet-like cleaning element 707 with respect to the direction of reciprocation, include the saw-toothed configuration as shown in FIG. 18A, the wavy configuration as shown in FIG. 18B and the rectangular wave configuration as shown In FIG. 18C.

Figure 19A:
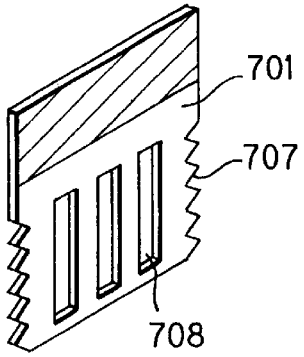
FIGS. 19A and 19B are perspective views of the same embodiment showing examples of cleaning elements with slots formed therein.
Figure 19B:
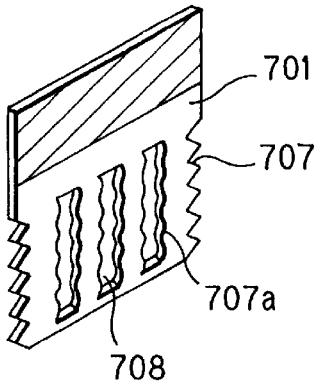

FIG. 19A shows an example where the cleaning element 701 with jagged edges 707 shown in FIG. 18A, 18B or 18C, has a number of slots 708 formed therein in parallel with the jagged edges. FIG. 19B shows an example where the cleaning element 701 has slots with jagged edges 707*a* on their long[]sides.

In either case, provision of slots 708 in cleaning element 701 enables the toner and other particles existing between toner layer metering blade 300 and cleaning element 701 to be discharged while cleaning element 701 is being slid, whereby it is possible to remove stuck buildups on the toner layer metering blade 300 in a more effective manner.

Figure 21B:
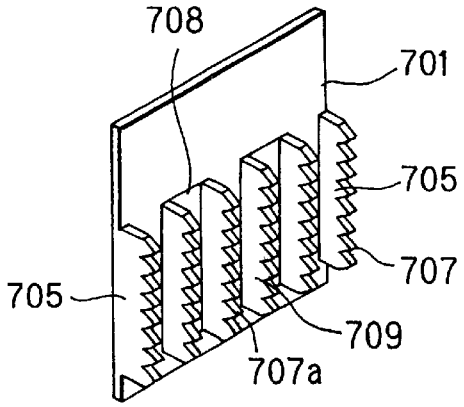

FIGS. 20 and 21A and 21B are perspective views showing cleaning elements 701 with sloping tabs, which are inclined when sectionally viewed. When cleaning element 701 is formed with sloping tabs 705 at both sides thereof, little effect can be obtained if slots 708 are formed in the cleaning element as is, differing from the situation of the thin sheet-like cleaning element 701.

In order to obtain effective enough function of slots 708 for removing buildups, the long side of each slot 708 is folded as shown in FIGS. 20 and 21A and 21B so as to form a folded portion 709 to solve the problem. In this case, as shown in FIG. 21B, the distal part of each folded portion 709 of slot 708 may be formed with a jagged edge 707*a*, whereby it is possible to further enhance the removal function of buildups.

The Ninth Embodiment

Figure 22:
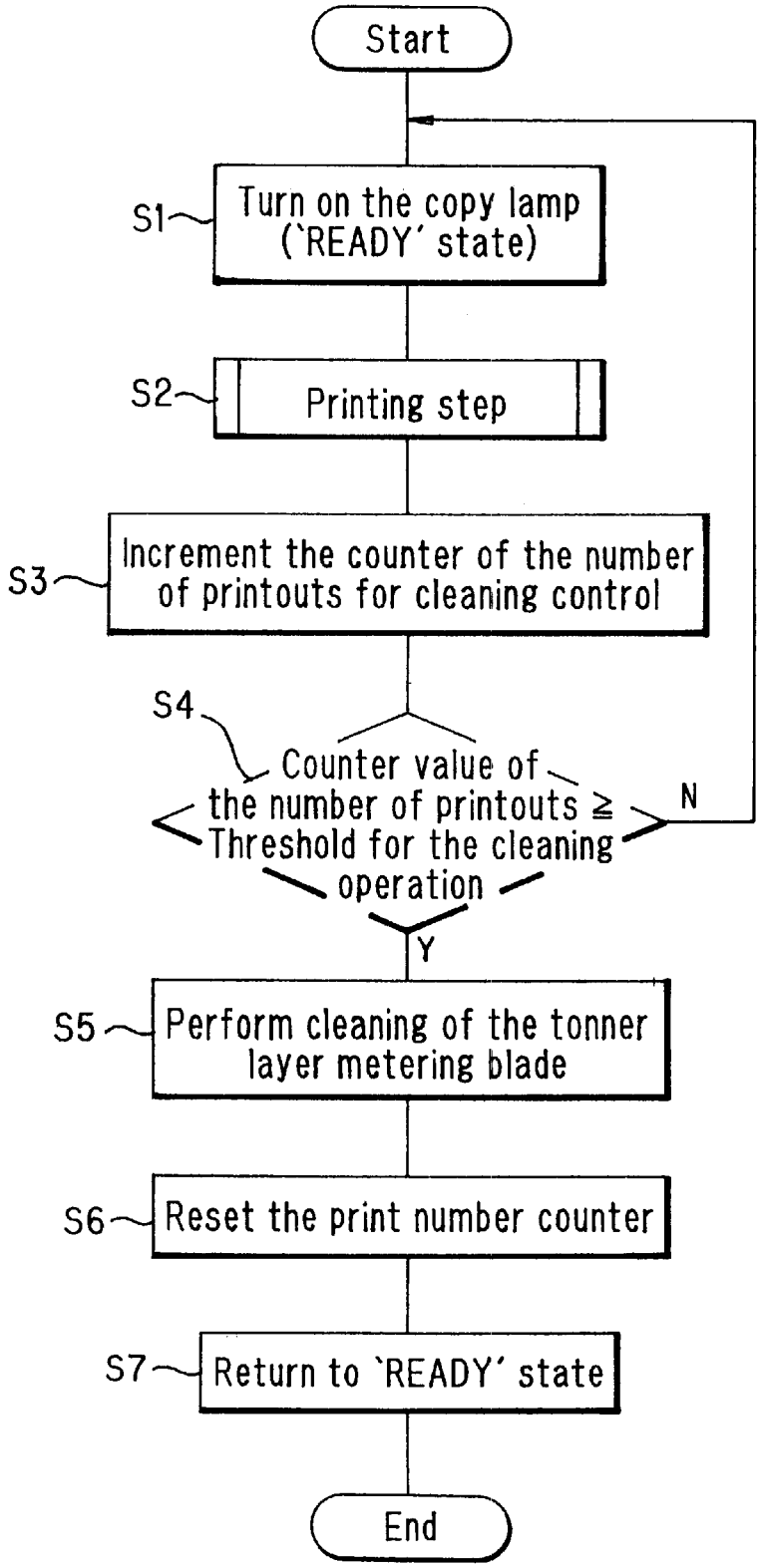
FIG. 22 is a schematic flowchart showing the cleaning operation in accordance with the ninth embodiment.

FIG. 22 is a schematic flowchart showing the operation of the cleaning element in accordance with the ninth embodiment, involving the operational timing of cleaning element.

This developer unit is applied to an image forming apparatus having a counter means for counting the number of printouts, and the apparatus is controlled so as to effect the cleaning operation when the count value on the counter means reaches the predetermined value.

A blade widthwise movement type cleaning operation includes both the movement along the blade width and the movement across the blade length while a blade lengthwise E∂movement type cleaning operation indicates the movement across the blade length. The cleaner drive device for a blade widthwise movement type may be configured by the mechanism employing the cam 721 with linkage mechanism 720, as explained in the third embodiment, and a movement mechanism of a cylinder, etc., or timing belt movement mechanism with a motor. The cleaner drive device for a blade lengthwise movement type may be configured by the mechanism employing a movement mechanism of a cylinder, etc., or timing belt movement mechanism with a motor. In either case, handle 703 is coupled with unillustrated associated components so that toner layer metering blade 300 is actuated to perform cleaning in response to reception of a cleaning element actuating signal from the controller.

The controller for controlling the cleaning operation is comprised of a micro computer including a CPU, ROM, RAM and other components, a rewritable memory device (electrically programmable memory such as EEPROM etc.) which allows the data (from the cleaning control counter for counting the number of printouts) necessary for controlling the cleaning operation to be overwritten and a counter means for counting the number of printouts. That is, the controller receives these signals and perform arithmetic operations so as to effect the predetermined cleaning operation.

With the above configuration, the image forming apparatus starts an image forming operation, form its ready state, as shown in FIG. 22. That is, the copy lamp is turned on(Step 1) to enter the printing process. When the printing operation is complete(Step 2), the number of printouts after the previous cleaning, i.e., cleaning control printout number counter is incremented by one(Step 3). Then, it is judged whether the number on the counter reaches the predetermined number(Step 4). The result of the judgement is affirmative, an operation signal for cleaning the toner layer metering blade is output so as to actuate the blade cleaning operation(Step 5). After finishing the cleaning operation, the cleaning control printout number counter is reset(Step 6) and the apparatus returns to the ready state.

With repetitions of the above operation, it is possible to perform the blade cleaning every predetermined number of printouts, to maintain beneficial images for a long period.

Though the cleaning operation in this example is controlled based on the number of printouts, the cleaning operation may be controlled based on the hours of operation of the apparatus, the time of rotation of the developer roller or combination of these. For example, the cleaning operation may be effected when any of these reaches its predetermined value or when plural count values have reached their predetermined values. Further, it is also possible to vary the aforementioned predetermined values by counting the number of the cleaning operations and based on the count. The control method can be selected as appropriate.

The Tenth Embodiment

Figure 23:
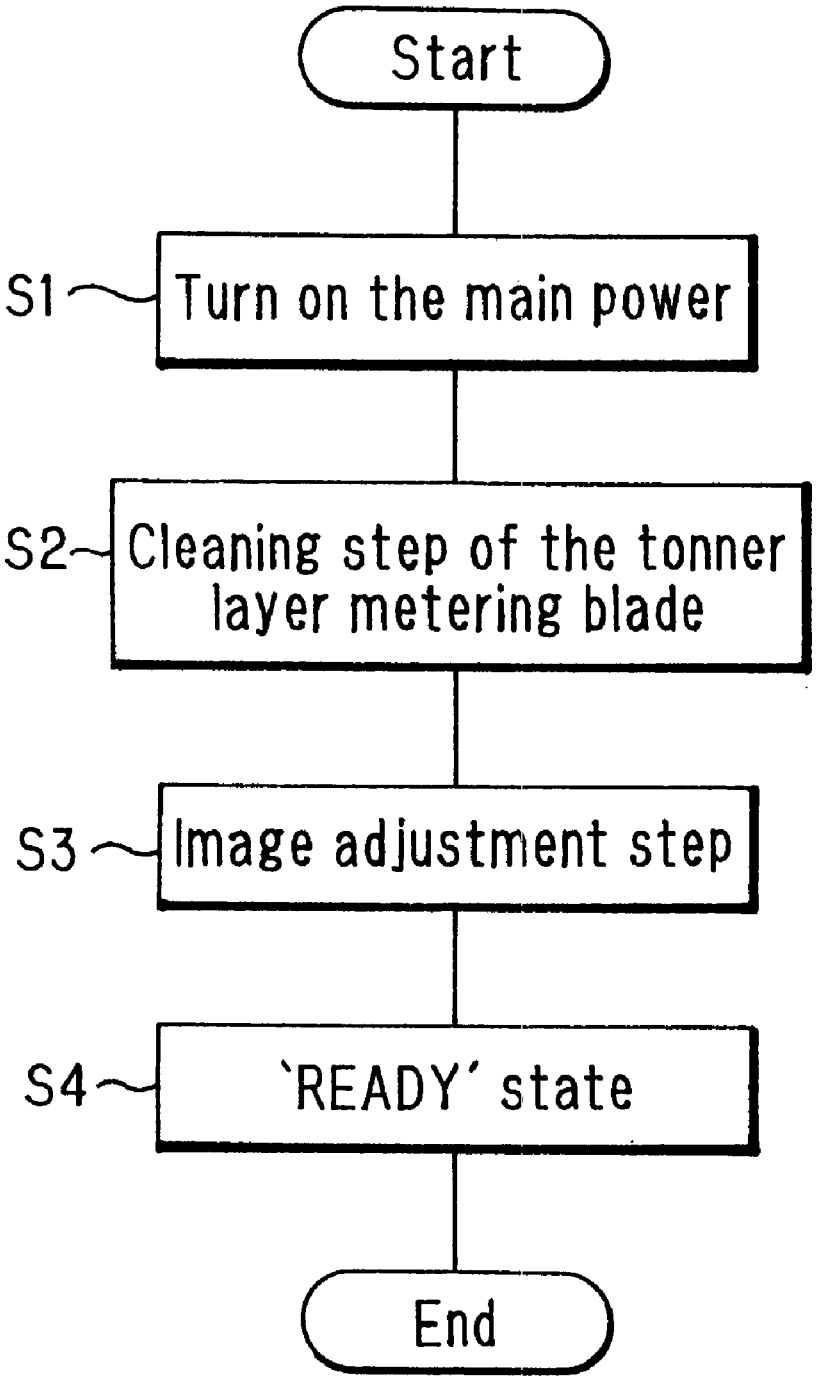
FIG. 23 is a flowchart showing the cleaning timing in accordance with tenth embodiment.

FIG. 23 is a flowchart showing the operation of the cleaning element in accordance with tenth embodiment. This embodiment is directed to the operational timing of cleaning as an example differing from the ninth embodiment, and is applied to an image forming apparatus having the image adjustment function for providing optimal images depending upon environmental changes and over long term use.

In this embodiment, the apparatus includes a controller for controlling the image forming processing conditions by performing image adjustment for optimal printed-out images when power is activated. This controller is adapted to control the cleaning element so as to actuate the cleaning portion so as to perform the cleaning operation before, or in parallel with, the image adjustment.

The mechanism for moving this cleaning element 700 is configured as in the ninth embodiment. That is, handle 703 of cleaning element 700 is coupled with unillustrated associated components. Toner layer metering blade 300 is actuated to perform cleaning in response to reception of a cleaning element actuating signal. The controller is comprised of a micro computer including a CPU, ROM, RAM and other components and controls the cleaning operation and image adjustment operation.

With the above configuration, as shown in FIG. 23, when the main power switch of the image forming apparatus is turned on (Step 1), the operation of cleaning the blade is performed(Step 2). Then, image adjustment is effected (Step 3). Image adjustment mentioned here refers to the control, for example, of developing a test pattern, sensing its developed image with a density sensor, determining deviation from the density reference and adjusting the image forming conditions so that the density will become close to the density reference.

To sum up, this embodiment is an example of the configuration of the invention as applied to an apparatus which performs image adjustment when the image forming apparatus is activated so that cleaning of the blade is performed before the image adjustment.

Execution of the image adjustment is not limited to be at the timing of power activation, but it can be done when the number of printouts reaches the predetermined value, when the operating time of the machine reaches the predetermined time or when the imaging apparatus recovers from the energy saving mode. The present invention can be applied to such a machine. Actually, cleaning the blade before performance of the image adjustment enables the image adjustment to be Ad performed with the blade clean, whereby it is possible to effect beneficial image adjustment under changing environmental conditions and in the long term use, leading to maintenance of high quality printing.

It should be noted that the cleaning operation may be performed in parallel with image adjustment, instead of being performed before image adjustment.

Other Embodiments

The present invention should not be limited to the embodiments heretofore. It should be understood that various changes and modifications may be made within the scope of the invention. For example, the cleaning elements made of a soft and flexible material and brush-like material shown information FIG. 10 were introduced as application to a blade widthwise movement type in which the cleaning element is moved from the fixed end to free end of the blade. However, these flexible/elastic type and brush type cleaning elements can be applied to a blade lengthwise movement configuration.

As a variational example of the first or seventh embodiment, both sides of the sheet-like cleaning element be configured to be tapered In the directions of movement, whereby the effect of removing buildups can be improved.

Further, in a system including the developer unit shown in FIG. 8 and the drive mechanism for cleaning element 700 shown in FIG. 9, the controller of controlling the operation of cleaning element 700 can be configured so as to perform cleaning of the distal part of toner layer metering blade 300 by actuating cleaning element 700 when the toner container cartridge is replaced for replenishing the developer hopper with fresh toner.

In this case, detection as to the replacement timing of the toner container cartridge is performed based on the signal from a touch sensor(pressure sensor), optical sensor, or the like, provided in the developer hopper. The controller may and should judge, in response to the signal from the sensor, whether the toner container cartridge is mounted to control the operation of the drive mechanism of cleaning element 700.

As has been apparent from the description heretofore, according to the present invention, since the cleaning element is arranged and can be frictionally slid along the backside of the toner layer metering blade, i.e., the side opposite to the surface in contact with the developer support, it is possible to remove the stuck toner on the toner layer metering blade or prevent sticking material from building up with a low risk of the cleaning element damaging the toner layer metering blade surface and the developer support surface abutted against the blade.

What is claimed is:

1. A developer unit comprising:

a toner layer metering blade disposed in pressure contact with a developer support surface for adjusting the thickness of the toner layer on the developer support surface; and a cleaning element for removing stuck toner around an abutment edge of the toner layer metering blade against a developer support, wherein the cleaning element is of a sheet-like configuration and arranged on a backside of the toner layer metering blade, the side opposite to the surface in contact with the developer support and can be frictionally slid perpendicular to the edge of the toner layer metering blade.

2. The developer unit according to claim 1, wherein the length of horizontal dimension of the cleaning element is set approximately equal to the length of horizontal dimension of the toner layer metering blade.

3. The developer unit according to claim 1, wherein both the sides or ridgelines at both horizontal ends of the cleaning element are inclined with respect to a direction of movement of the cleaning element.

4. The developer unit according to claim 1, wherein the cleaning element is of a sheet-like configuration and the width, or dimension of projection from a proximal end, of the cleaning element varies along the long side of the toner layer metering blade.

5. The developer unit according to claim 4, wherein the cleaning element has an axial symmetrical shape about the medial line with respect to the length thereof with its width or the dimension of projection from its proximal end on the left is the mirror image of that on the right.

6. The developer unit according to claim 5, wherein the width or dimension of projection from its proximal end of the cleaning element varies linearly.

7. A developer unit comprising:

a toner layer metering blade disposed in pressure contact with a developer support surface for adjusting the thickness of the, toner layer on the developer support surface; and a cleaning element for removing stuck toner around an abutment edge of the toner layer metering blade against a developer support, wherein the cleaning element is comprised of a soft and flexible member applied on an elastic thin plate-like support, is arranged on a backside of the toner layer metering blade, the side opposite to the surface in contact with the developer support and can be frictionally slid perpendicular to the edge of the toner layer metering blade.

8. A developer unit comprising:

a toner layer metering blade disposed in pressure contact with a developer support surface for adjusting the thickness of the toner layer on the developer support surface; and a cleaning element for removing stuck toner around an abutment edge of the toner layer metering blade against a developer support, wherein the cleaning element is comprised of a brush-like member applied to an elastic thin plate-like support, is arranged on a backside of the toner layer metering blade, the side opposite to the surface in contact with the developer support and can be frictionally slid perpendicular to the edge of the toner layer metering blade.

9. The developer unit according to claim 1, wherein the cleaning element is integrally attached to the toner container cartridge for supplying fresh toner.

10. A developer unit comprising:

a toner layer metering blade disposed in pressure contact with a developer support surface for adjusting the thickness of the toner layer on the developer support surface; and a cleaning element for removing stuck toner around an abutment edge of the toner layer metering blade against a developer support, wherein the cleaning element is arranged on a backside of the toner layer metering blade, the side opposite to the surface in contact with the developer support, and attached to an agitating element inside the developer unit so as to clean the distal part of the toner layer metering blade in time with the agitating action of the agitating element.

11. A developer unit comprising:

a toner layer metering blade disposed in pressure contact with a developer support surface for adjusting the thickness of the toner layer on the developer support surface; and a cleaning element for removing stuck toner around an abutment edge of the toner layer metering blade against a developer support, wherein the cleaning element is arranged on a backside of the toner layer metering blade, the side opposite to the surface in contact with the developer support and can be frictionally slid parallel to the edge of the toner layer metering blade.

12. The developer unit according to claim 11, wherein the cleaning element can be reciprocated or vibrated parallel to the edge of the toner layer metering blade.

13. The developer unit according to claim 11, comprising:

a toner layer metering blade disposed in pressure contact with the developer support surface for adjusting the thickness of the toner layer on the developer support surface; and a cleaning element for removing stuck toner around the abutment edge of the toner layer metering blade against the developer support, wherein the cleaning element is of a sheet-like configuration, is arranged on the backside of the toner layer metering blade, the side opposite to the surface in contact with the developer support and can be frictionally slid parallel to the edge of the toner layer metering blade.

14. The developer unit according to claim 13, wherein the sheet-like cleaning element has a pair of sloping tabs on both sides thereof with respect to the direction of movement, the edges of the sloping tabs are frictionally slidable along the toner layer metering blade.

15. The developer unit according to claim 13, wherein each of both side parts of the sheet-like cleaning element is thick at a proximal side and is tapered to a distal edge toward the direction of movement.

16. The developer unit according to claim 13, wherein both side parts of the sheet-like cleaning element with respect to the direction of movement are formed with jagged edges.

17. The developer unit according to claim 16, wherein both side parts of the sheet-like cleaning element with respect to the reciprocating direction are formed with wavy jagged edges.

18. The developer unit according to claim 16, wherein both side parts of the sheet-like cleaning element with respect to the reciprocating direction are formed with saw-toothed jagged edges.

19. The developer unit according to claim 16, wherein both side parts of the sheet-like cleaning element with respect to the reciprocating direction are formed with rectangular wavy jagged edges.

20. The developer unit according to claim 13, wherein the sheet-like cleaning element has slots in parallel with the both side edges with respect to the reciprocating direction.

21. The developer unit according to claim 16, wherein the sheet-like cleaning element has slots in parallel with the both side edges with respect to the reciprocating direction, and the edge of the longest side of each slot is folded forming a folded portion.

22. The developer unit according to claim 21, wherein the edge of the longest side of each slot is folded and the folded portion is formed with a jagged edge.

23. A developer unit comprising:

a toner layer metering blade disposed in elastic contact with a developer support surface for adjusting the thickness of the toner layer on the developer support surface; and a cleaning element for removing stuck toner around an abutment edge of the toner layer metering blade against a developer support, wherein the cleaning element is comprised of a soft and flexible member applied to a thin plate-like support, is arranged on a backside of the toner layer metering blade, the side opposite to the surface in contact with the developer support and can be frictionally slid parallel to the edge of the toner layer metering blade.

24. A developer unit comprising:

a toner layer metering blade disposed in elastic contact with a developer support surface for adjusting the thickness of the toner layer on the developer support surface; and a cleaning element for removing stuck toner around an abutment edge of the toner layer metering blade against a developer support, wherein the cleaning element is comprised of a brush-like member applied to a thin plate-like support, is arranged on a backside of the toner layer metering blade, the side opposite to the surface in contact with the developer support and can be frictionally slid parallel to the edge of the toner layer metering blade.

25. The developer unit according to claim 1, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

26. The developer unit according to claim 1, which is applied to an image forming apparatus including a controller for controlling the image forming process conditions and the like by effecting image adjustment so as to provide optimal printed-out images when power is activated, when the number of printouts reaches the predetermined value, when the predetermined time elapses and/or when the machine has recovered from the energy saving mode, wherein the controller controls the cleaning element so as to perform the cleaning operation before or in parallel with the image adjustment.

27. The developer unit according to claim 1, further comprising a controller for controlling the operation of the cleaning element, wherein the controller controls the cleaning element so that the cleaning element cleans the distal part of the toner layer metering blade when the toner container cartridge is replaced to replenish fresh toner to the developer hopper.

28. The developer unit according to claim 7, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

29. The developer unit according to claim 7, which is applied to an image forming apparatus including a controller for controlling the image forming process conditions and the like by effecting image adjustment so as to provide optimal printed-out images when power is activated, when the number of printouts reaches the predetermined value, when the predetermined time elapses and/or when the machine has recovered from the energy saving mode, wherein the controller controls the cleaning element so as to perform the cleaning operation before or in parallel with the image adjustment.

30. The developer unit according to claim 7, further comprising a controller for controlling the operation of the cleaning element, wherein the controller controls the cleaning element so that the cleaning element cleans the distal part of the toner layer metering blade when the toner container cartridge is replaced to replenish fresh toner to the developer hopper.

31. The developer unit according to claim 8, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

32. The developer unit according to claim 8, which is applied to an image forming apparatus including a controller for controlling the image forming process conditions and the like by effecting image adjustment so as to provide optimal printed-out images when power is activated, when the number of printouts reaches the predetermined value, when the ipredetermined time elapses and/or when the machine has recovered from the energy saving mode, wherein the controller controls the cleaning element so as to perform the cleaning operation before or in parallel with the image adjustment.

33. The developer unit according to claim 8, further comprising a controller for controlling the operation of the cleaning element, wherein the controller controls the cleaning element so that the cleaning element cleans the distal part of the toner layer metering blade when the toner container cartridge is replaced to replenish fresh toner to the developer hopper.

34. The developer unit according to claim 11, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

35. The developer unit according to claim 11, which is applied to an image forming apparatus including a controller for controlling the image forming process conditions and the like by effecting image adjustment so as to provide optimal printed-out images when power is activated, when the-number of printouts reaches the predetermined value, when the predetermined time elapses and/or when the machine has recovered from the energy saving mode, wherein the controller controls the cleaning element so as to perform the cleaning operation before or in parallel with the image adjustment.

36. The developer unit according to claim 11, further comprising a controller for controlling the operation of the cleaning element, wherein the controller controls the cleaning element so that the cleaning element cleans the distal part of the toner layer metering blade when the toner container cartridge is replaced to replenish fresh toner to the developer hopper.

37. The developer unit according to claim 23, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

38. The developer unit according to claim 23, which is applied to an image forming apparatus including a controller for controlling the image forming process conditions and the like by effecting image adjustment so as to provide optimal printed-out images when power is activated, when the number of printouts reaches the predetermined value, when the predetermined time elapses and/or when the machine has recovered from the energy saving mode, wherein the controller controls the cleaning element so as to perform the cleaning operation before or in parallel with the image adjustment.

39. The developer unit according to claim 23, further comprising a controller for controlling the operation of the cleaning element, wherein the controller controls the cleaning element so that the cleaning element cleans the distal part of the toner layer metering blade when the toner container cartridge is replaced to replenish fresh toner to the developer hopper.

40. The developer unit according to claim 24, which is applied to an image forming apparatus including a counter means capable of counting, at least one of the number of printouts, the operating time and the number of rotations of the developer support and is controlled so that the cleaning operation is performed when the counted value on the counter means reaches the predetermined value.

41. The developer unit according to claim 24, which is applied to an image forming apparatus including a controller for controlling the image forming process conditions and the like by effecting image adjustment so as to provide optimal printed-out images when power is activated, when the number of printouts reaches the predetermined value, when the predetermined time elapses and/or when the machine has recovered from the energy saving mode, wherein the controller controls the cleaning element so as to perform the cleaning operation before or in parallel with the image adjustment.

42. The developer unit according to claim 24, further comprising a controller for controlling the operation of the cleaning element, wherein the controller controls the cleaning element so that the cleaning element cleans the distal part of the toner layer metering blade when the toner container cartridge is replaced to replenish fresh toner to the developer hopper.

* * * * *